US007374273B2

(12) United States Patent
Miura

(10) Patent No.: US 7,374,273 B2
(45) Date of Patent: May 20, 2008

(54) DROPLET EJECTING DEVICE, DROPLET EJECTING METHOD, AND ELECTRONIC OPTICAL DEVICE

(75) Inventor: Hirotsuna Miura, Nagano-ken (JP)

(73) Assignee: Seiko Epson Corporation (JP)

( * ) Notice: Subject to any disclaimer, the term of this patent is extended or adjusted under 35 U.S.C. 154(b) by 435 days.

(21) Appl. No.: 10/696,737

(22) Filed: Oct. 29, 2003

(65) Prior Publication Data

US 2004/0135847 A1 Jul. 15, 2004

(30) Foreign Application Priority Data

Nov. 20, 2002 (JP) ..... 2002-337121
Aug. 22, 2003 (JP) ..... 2003-299317

(51) Int. Cl.
*B41J 2/14* (2006.01)
*B41J 29/393* (2006.01)

(52) U.S. Cl. ..... 347/51; 347/19

(58) Field of Classification Search ..... 347/19, 347/51, 54, 68, 74
See application file for complete search history.

(56) References Cited

U.S. PATENT DOCUMENTS 3,878,519 A 4/1975 Eaton
4,509,057 A * 4/1985 Sohl et al. ..... 347/19
6,364,459 B1 4/2002 Sharma et al.
6,513,900 B2 * 2/2003 Endo et al. ..... 347/19
6,659,584 B2 12/2003 Miura et al.
2002/0054188 A1 5/2002 Sharma et al.

FOREIGN PATENT DOCUMENTS

| | | |
|---|---|---|
| JP | 50-110230 | 8/1975 |
| JP | 01-238950 | 9/1989 |
| JP | 11-179884 | 7/1999 |
| JP | 2001-138508 | 5/2001 |
| JP | 2002-164635 | 6/2002 |

OTHER PUBLICATIONS

Communication from Korean Patent Office re: related application.

* cited by examiner

*Primary Examiner*—An H. Do
(74) *Attorney, Agent, or Firm*—Harness, Dickey & Pierce, P.L.C.

(57) ABSTRACT

A droplet ejecting device includes an ejector that is adapted to eject a liquid stored in a pressure chamber from an ejecting nozzle, by applying pressure to the pressure chamber; an ejection timing detector that is adapted to detect a start timing at which a liquid column starts being ejected from the ejecting nozzle; a droplet separator that is adapted to give, to the liquid column, an energy that separates the liquid column from the liquid stored in the pressure chamber; and a controller that is adapted to control the droplet separator to give an energy at a timing when a predetermined time period has elapsed since the start timing detected by the ejection timing detector.

10 Claims, 23 Drawing Sheets

DROPLET EJECTING DEVICE, DROPLET EJECTING METHOD, AND ELECTRONIC OPTICAL DEVICE

TECHNICAL FIELD

The present invention relates to a droplet ejecting device and a droplet ejecting method for ejecting a droplet, and to an electronic optical device manufactured using the method.

BACKGROUND ART

A well-known patterning method employs a droplet ejecting device for forming a wiring pattern on a substrate. The droplet ejecting device generally drops onto a substrate liquid containing a functional material such as silver particles, thereby fixing the functional material on the substrate to form a wiring pattern. Such a patterning method is described, for example, in Japanese Patent Application Laid-Open Publication No. 2002-164635. The method enables cost effective wiring patterning requiring only a simple mechanical configuration as compared to a vapor deposition method using a shadow mask.

FIGS. 12A to 12C are cross-sectional views of a major part of a conventional droplet ejecting device. The respective views illustrate a process of droplet formation and ejection from a pressure chamber 910 through a nozzle 930. In the figures, a droplet ejected from nozzle 930 is assumed to have a volume of 10 pl (picolitter: $10^{-15}$ $m^3$). As shown in FIG. 12A, a surface 912 of pressure chamber 910, and which is in connective communication with a liquid tank 900, is deformed by means of a piezoelectric element 920 in a direction away from the interior of the chamber 910 to become convex, whereby a liquid in pressure chamber 910 is depressurized, and the liquid is allowed to flow from liquid tank 900 into pressure chamber 910. Conversely, in FIG. 12B, surface 912 of pressure chamber 910 is deformed by means of piezoelectric element 920 in a direction towards the interior of the chamber 910 to become concave, whereby the liquid in the chamber 910 is subject to increased pressure. As a result, a column of the liquid is caused to protrude from nozzle 930. As shown in FIG. 12C, when the liquid in pressure chamber 910 is again depressurized, the liquid column retracts into pressure chamber 910 through nozzle 930. During retraction, the liquid column separates at a neck portion formed under an inertial force, and a droplet is ejected from an ejecting head.

A liquid generally used for the patterning of the wiring contains a large quantity of fine conductive particles such as silver particles. That is, the liquid used for patterning is generally of a relatively high viscosity as compared to, for example, pigment type ink; and may have a viscosity of as high as 20 mPa·s (Pascal per second). To achieve high-precision wiring patterning, it is necessary to eject microscopic droplets from a droplet ejecting device.

However, the higher the viscosity of a liquid from which droplets are ejected from a droplet ejecting device, the more difficult it is to form a droplet of a sufficiently small volume (i.e., to micronize a droplet), which makes it difficult to carry out high-precision patterning. An example of this problem is illustrated in FIGS. 13A and 13B. The figures show a failure to create a microscopic droplet of about 2 pl from a high viscosity liquid being ejected from a droplet ejecting device. As described above, when a liquid in pressure chamber 910 is depressurized and then pressurized, a liquid column protrudes from nozzle 930 (see FIG. 13A). However, since an intermolecular force acting within a high viscosity liquid is large, the liquid column retracts into pressure chamber 910 without droplet separation taking place, even if the liquid in pressure chamber 910 is once again depressurized (see FIG. 13B).

In an attempt to overcome this problem it is possible to increase a speed at which a liquid column is ejected, or alternatively it is possible to increase a volume of the column. However, neither approach provides a satisfactory result. If the ejection speed of the liquid column is increased, spattering tends to result; also the ejected liquid droplets tend to shift from their intended trajectory and hit the substrate inaccurately. In the case of increasing a volume of the liquid column, it becomes impossible to form microscopic droplets. Thus, to date, a droplet ejecting device that is capable of micronizing droplets from a high viscosity liquid has not been available.

SUMMARY

The present invention has been conceived in consideration of the above mentioned problems, and an object of the invention is to provide a droplet ejecting method that enables reliable ejection of microscopic droplets, a droplet ejecting device using the method, and an electronic optical device manufactured using the method.

To solve the above-mentioned problems, a droplet ejecting device according to the present invention comprises ejecting means for ejecting a liquid stored in a pressure chamber from an ejecting nozzle, which is achieved by applying pressure to the pressure chamber; and droplet formation assisting means for giving, to the liquid being ejected from the ejecting nozzle, an energy that assists droplet formation.

According to the droplet ejecting device of the present invention, by the droplet formation assisting means a droplet is formed, from a liquid ejected from an ejecting nozzle. The droplet ejecting device enables reliable ejection of microscopic droplets from a high viscosity liquid.

In one preferred embodiment, the droplet formation assisting means gives energy from a side direction to a side surface of the liquid ejected from the ejecting nozzle.

Preferably, the energy is optical energy such as coherent-light energy, or may be thermal energy. Further, the optical energy may comprise plural light beams traveling in different directions or at least two light beams traveling in opposite directions.

In another preferred embodiment, the droplet ejecting device further comprises ejection timing detection means for detecting a timing at which a liquid starts being ejected from the ejecting nozzle; and control means for controlling the droplet formation assisting means to assist formation of a droplet at a timing when a predetermined time period has elapsed since the timing detected by the ejecting timing detection means.

Optimizing a timing of assisting droplet formation using the control means enables a droplet of a desired volume to be formed. Preferably, the control means sets a longer period as a predetermined time period when the volume of liquid to be ejected is larger.

In still another preferred embodiment, the droplet ejecting device further comprises light emission means for emitting light onto the liquid being ejected from the ejecting nozzle; and photoreception means facing the light emission means for receiving light emitted by the light emission means through the liquid being ejected from the ejecting nozzle, wherein the ejection timing detection means detects a timing at which ejection of the liquid starts in response to a change in the intensity of light received by the photoreception means. The droplet formation assisting means is able to assist formation of a droplet by emitting from the light emission means light having an energy that is greater than the energy of the light used for detecting the timing at which ejection of the liquid starts.

In addition to the droplet ejecting device, the present invention provides a droplet ejecting method for controlling ejection of droplets by the droplet ejecting device. The method comprises an ejecting step of ejecting a liquid stored in a pressure chamber from an ejecting nozzle of the pressure chamber by applying pressure to the pressure chamber; and a droplet formation assisting step for giving, to the liquid being ejected from the ejecting nozzle, an energy that assists formation of a droplet. As in the droplet ejecting device according to the present invention, the method ensures reliable ejection of droplets regardless of the viscosity of a liquid used to form the droplets.

Preferably, the energy used in the method is optical energy such as coherent-light energy, or it may be thermal energy. Further, the optical energy may comprise plural light beams traveling in different directions or at least two light beams traveling in opposite directions.

In another preferred embodiment, the method further comprises an ejection timing detecting step of detecting a timing at which ejection of the liquid from the ejecting nozzle starts; and the droplet formation assisting step is started at a timing when a predetermined time period has elapsed since a detected timing of the liquid ejection. Preferably, in the droplet formation assisting step, a longer period is set as a predetermined time period where the volume of liquid to be ejected is larger.

In another preferred embodiment, the ejection timing detecting step includes emitting light from a light emission means for emitting light onto the liquid being ejected from the ejecting nozzle; receiving light emitted from the light emission means by a photoreception means that faces the light emission means through the liquid being ejected; and detecting a timing of ejection of the liquid occurs in response to a change in the intensity of light received by the photoreception means. Preferably, in the droplet formation assisting step, formation of a droplet is assisted by emitting from the light emission means a light of a greater energy than the energy of the light used for detecting a timing at which ejection of the liquid starts.

The droplet ejecting method may be applied to any of: patterning a wiring; a color filter; a photoresist; an electroluminescence material; a microlens array; a bio-substance or to patterning of an element included in an electronic optical device.

The present invention further provides an electronic optical device comprising an element that has been patterned using the droplet ejecting method. Such an electronic optical device may include a liquid crystal device, an organic EL (electroluminescence) display device, a plasma display device, SED (Surface-Conduction Electron-Emitter Display), and an emitter substrate.

DETAILED DESCRIPTION OF PREFERRED EMBODIMENTS

Hereinafter, an embodiment of the present invention will be described with reference to the attached drawings.

Figure 1:
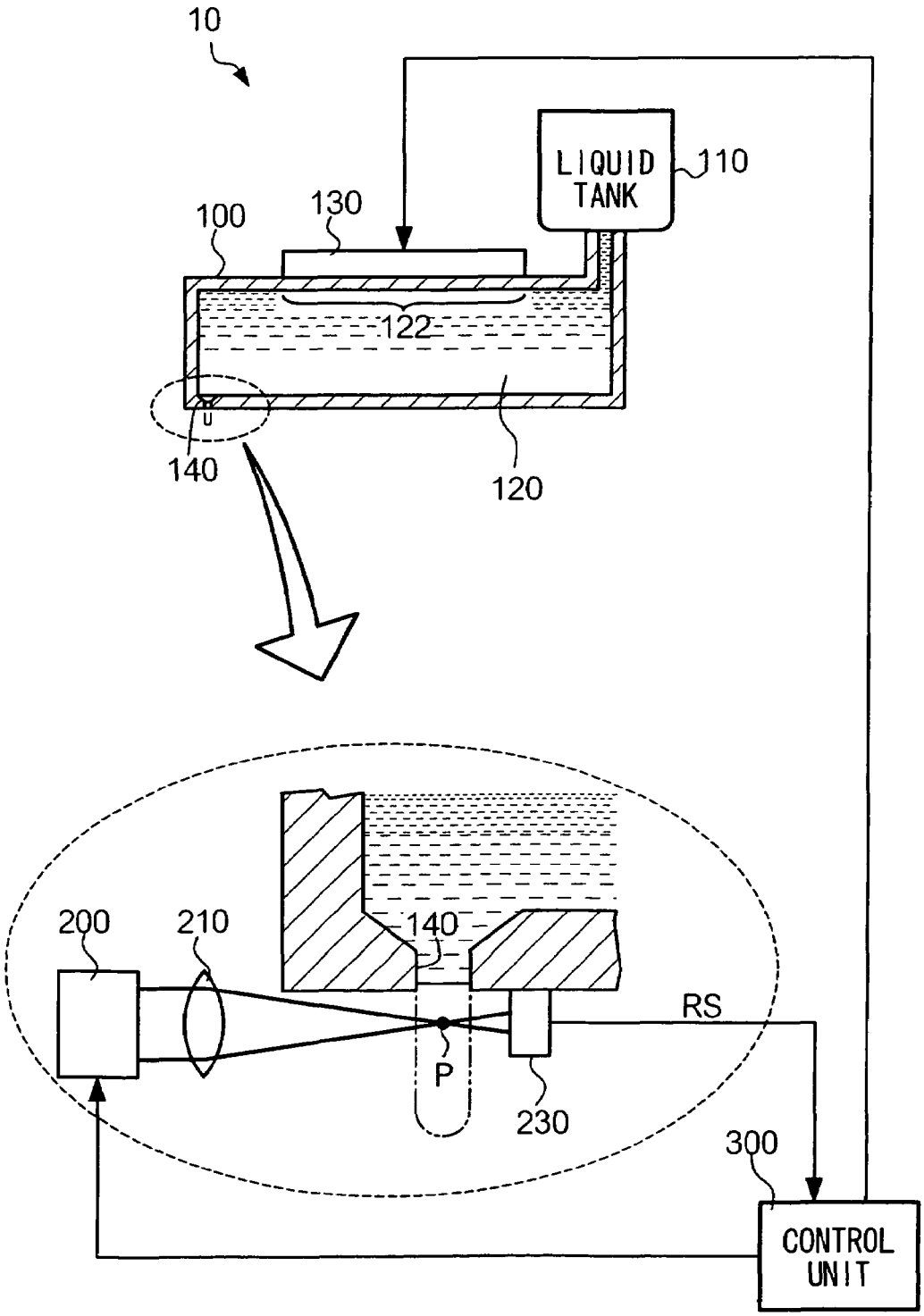
FIG. 1 is a diagram showing a peripheral configuration of an ejecting head included in a droplet ejecting device according to an embodiment.

FIG. 1 shows a peripheral configuration of an ejecting head of a droplet ejecting device according to an embodiment of the present invention. In the figure, a liquid tank 110 stores a liquid containing functional materials, and which is to be ejected from an ejecting head 100. Specifically, liquid tank 110 stores a liquid having a viscosity of about 20 mPa·s, and comprising microscopic particles of silver mixed into an organic solvent such as $C_{14}H_{30}$ (n-tetradecane). The liquid is used for the wiring patterning and is ejected from droplet ejecting device 10 as a droplet having a volume of 2 pl. It is to be noted, as is described later in various applications of droplet ejecting device 10, that the liquid ejected from the device 10 is not limited to a liquid used for wiring patterning, but may include any of: a liquid containing EL materials; an ink used for manufacturing a color filter for the liquid crystal display; a liquid containing photoresist materials; or a printing ink.

A pressure chamber 120 is in connective communication with liquid tank 110 and temporarily stores a liquid that is allowed to flow from the tank 110 into the chamber 120. A piezoelectric element 130, in response to driving signals supplied from a control unit 300, deforms a surface 122 of pressure chamber 120 to become convex in a direction towards or away from the interior of the chamber 120, thereby controlling a pressure applied to the liquid stored in chamber 120. The liquid in pressure chamber 120 is depressurized when surface 122 of the chamber 120 is deformed to become convex in a direction outwardly from the chamber 120, and is subject to increased pressure when surface 122 is deformed to become convex inwardly from the chamber 120.

When the liquid in pressure chamber 120 is pressurized, a liquid column (indicated by two-point chain lines) is ejected from a nozzle 140; and the ejected column is retracted into the chamber 120 when the liquid in the chamber 120 is depressurized. In the present embodiment, a total of three nozzles 140 are provided for droplet ejecting device 10, but the number of nozzles may be either greater or less.

Proximate to each of the nozzles 140 there is provided a laser 200, a cylindrical lens 210, and a photoreceptor 230 that together assist formation of a droplet from a liquid column.

Figure 2:
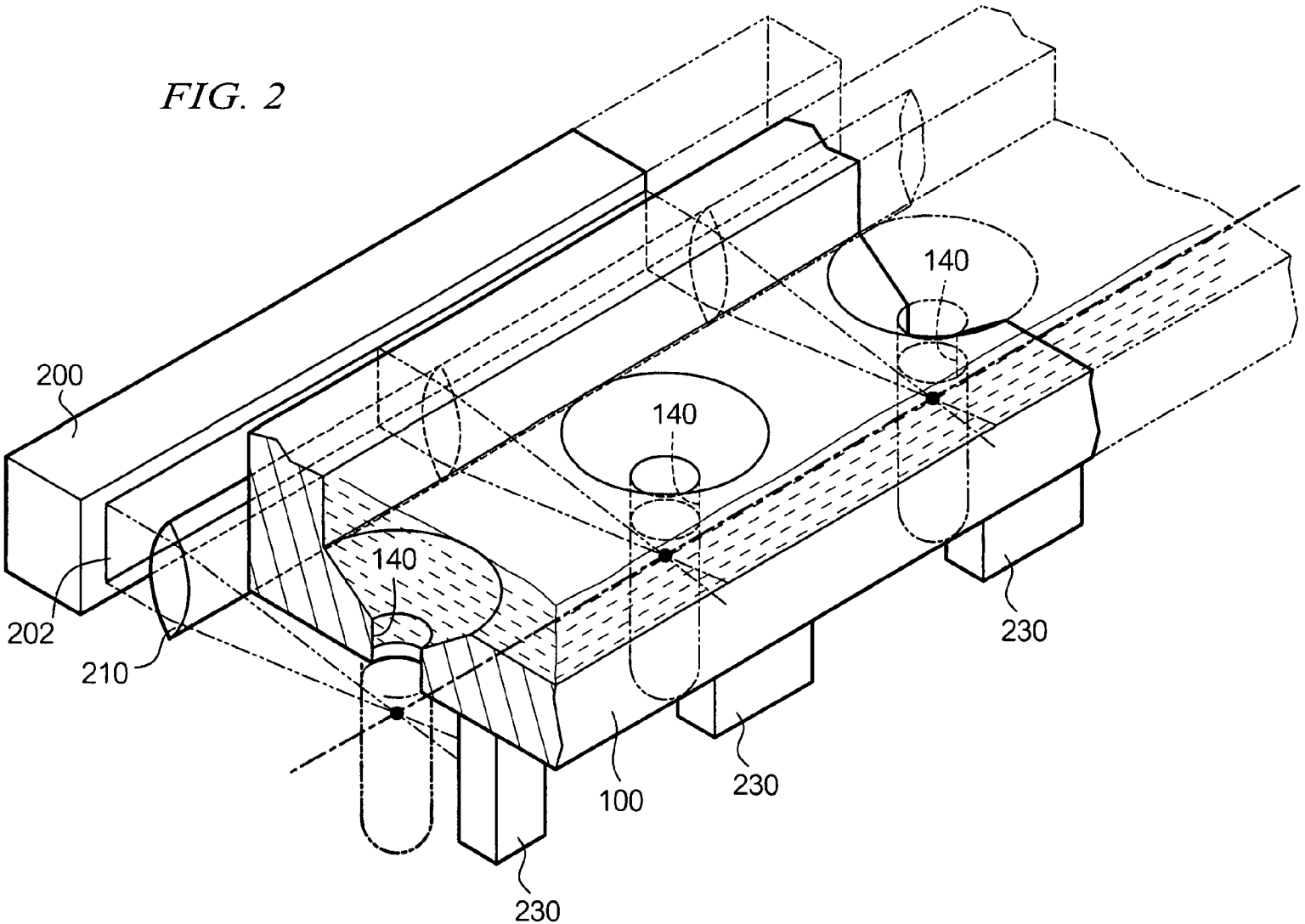
FIG. 2 is a perspective view of a peripheral configuration of nozzles in the droplet ejecting device.

FIG. 2 is a schematic view of laser 200 and cylindrical lens 210. As shown in the figure, laser 200 has a strip-shaped emitting surface 202 emitting laser beam, and is able to emit either a high or low-power laser beam. Cylindrical lens 210 is a convex lens, and concentrates a laser beam emitted from laser 200 along a straight line to penetrate each liquid column ejected from each nozzle 140. In other words, laser 200 and cylindrical lens 210 give energy to a side surface of the protruded liquid column.

Next, a difference between a low-power laser beam and a high-power laser beam emitted from laser 200 will be explained. The high-power laser beam, when it is concentrated on a liquid column by means of cylindrical lens 210, causes a point in the column at which it is concentrated to heat up. The high-power laser beam accelerates a droplet separation (as is explained in more detail later in the description), thereby assisting formation of a droplet from the liquid column. Conversely, a low-power laser beam gives almost no heat to the liquid column, and is instead employed to detect a starting point of ejection of the liquid.

In FIGS. 1 and 2, a photoreceptor 230 is provided facing laser 200 and positioned behind each liquid column when viewed from laser 200 so as to correspond respectively to each nozzle 140. In other words, each photoreceptor 230 is provided facing laser 200 through each liquid column. Photoreceptor 230 detects a liquid ejecting starting point in response to a reception of a low-power laser beam. Specifically, when no liquid is being ejected, photoreceptor 230 receives a low-power laser beam with little loss of power because there is no obstacle between cylindrical lens 210 and photoreceptor 230. Upon receiving a low-power laser beam, photoreceptor 230 supplies a reception signal RS to control unit 300. On the other hand, a laser beam does not reach photoreceptor 230 once the liquid column has started to protrude to such an extent that it intercepts the laser beam emitted from laser 200 toward photoreceptor 230. The laser beam is instead reflected, absorbed or scattered, and does not reach photoreceptor 230. Photoreceptor 230, when detecting that the low-power laser beam is no longer received, stops supplying the reception signal RS to control unit 300.

Figure 3:
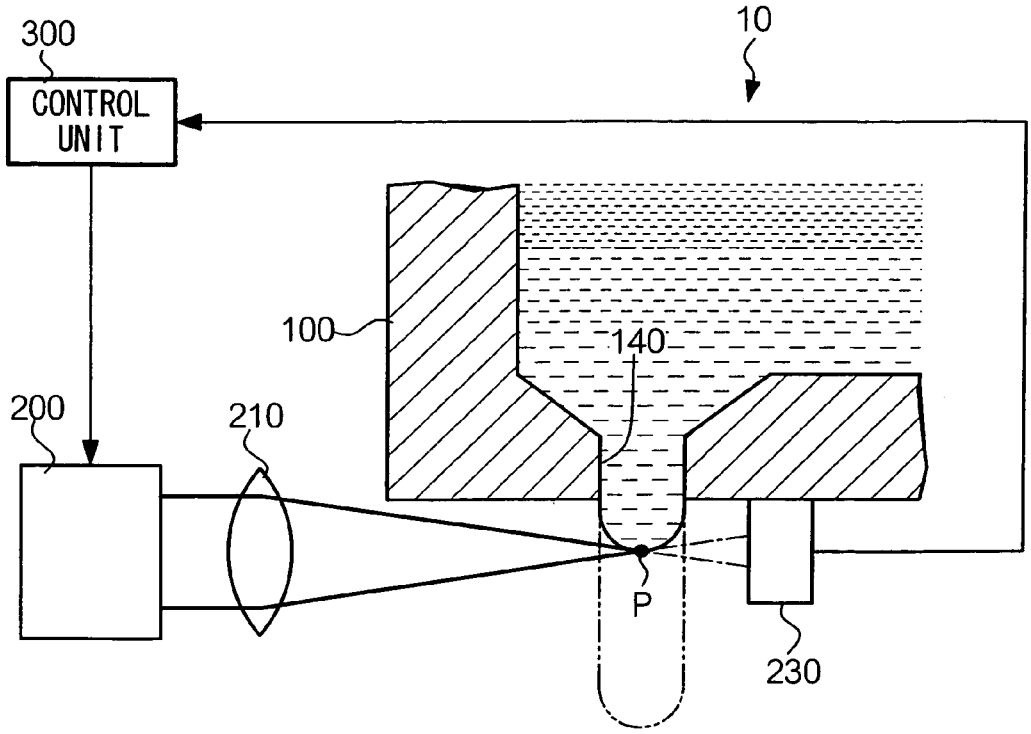
FIG. 3 is a diagram showing a peripheral configuration of a nozzle in the droplet ejecting device.

FIG. 3 is a diagram showing a point at which a liquid column growing and protruding from the nozzle 140 is about to intercept an optical path of the laser beam. As shown in the figure, when the head of the liquid column reaches the concentrated point of the laser beam, the laser beam is reflected, absorbed, or scattered by the liquid column. Photoreceptor 230, when the laser beam is prevented from reaching photoreceptor 230 by the liquid column, stops supplying the reception signal RS to control unit 300. Thus, photoreceptor 230 is a means for detecting whether a liquid column is present in the optical path of the laser beam between laser 200 and photoreceptor 230. Therefore, in the case that the device 10 is configured such that the laser beam is not completely intercepted by a liquid column, photoreceptor 230 may be configured to stop supplying reception signal RS upon detecting a decrease in the reception level of the laser beam.

In FIG. 1, control unit 300, which comprises a central processing unit (CPU), a timer clock and other parts, drives piezoelectric element 130 and laser 200 to eject droplets from droplet ejecting device 10. Specifically, control unit 300 drives piezoelectric element 130 to pressurize or depressurize a liquid in pressure chamber 120, and switches the power level of the laser beam emitted from laser 200 depending on the presence or absence of the reception signal RS supplied from photoreceptor 230.

Further, there are provided in droplet ejecting device 10 a head carriage for carrying ejecting head 100, a mechanism for carrying a medium to which droplets are applied such as a substrate or the like, and other parts, a detailed explanation of which will be omitted herein because they can be readily implemented using well-known techniques in the art. For the same reason, explanations will be omitted regarding how to control ejecting head 100 and piezoelectric element 130 in order to apply droplets on desired positions of the medium to which droplets are applied (i.e., the control of ejecting head 100 and piezoelectric element 130 for patterning).

With the configuration of droplet ejecting device 10 as described above, a microscopic droplet having a volume of 2 pl is ejected at an initial speed of 7 m/s. This process will be described below in detail.

First, control unit 300 causes laser 200 to emit a low-power laser beam. Control unit 300 then supplies drive signals to piezoelectric element 130 and deforms surface 122 of pressure chamber 120, causing it to become convex in an outward direction from the interior of chamber 120. As a result, as has been described in the background art, the liquid in pressure chamber 120 is depressurized, allowing the liquid to flow from liquid tank 110 into pressure chamber 120. Subsequently, control unit 300 pressurizes the liquid contained in pressure chamber 120 by means of piezoelectric element 130, thereby causing a liquid column to protrude from nozzle 140. The liquid contained in pressure chamber 120 is of a high viscosity of as much as 20 mPa·s. Therefore, even if the liquid in pressure chamber 120 is depressurized after ejecting the liquid column, for example, at the speed of 7 m/s, the liquid column is retracted into the chamber 120 without being separated from the liquid in pressure chamber 120. Thus, droplets are not ejected when only the conventional steps of pushing (i.e., ejection) and pulling (i.e., inhalation) the liquid column are performed. In order to solve the problem, droplet ejecting device 10 according to the present embodiment ejects droplets by assisting the formation of droplets from the liquid column using push-and-pull operations as described below.

While performing control operations of ejecting a liquid column by means of piezoelectric element 130, control unit 300 detects a point at which the head of the liquid column being ejected reaches a concentration point P in the path of the laser beam by detecting a point at which control unit 300 no longer receives reception signal RS supplied from photoreceptor 230.

Figure 4:
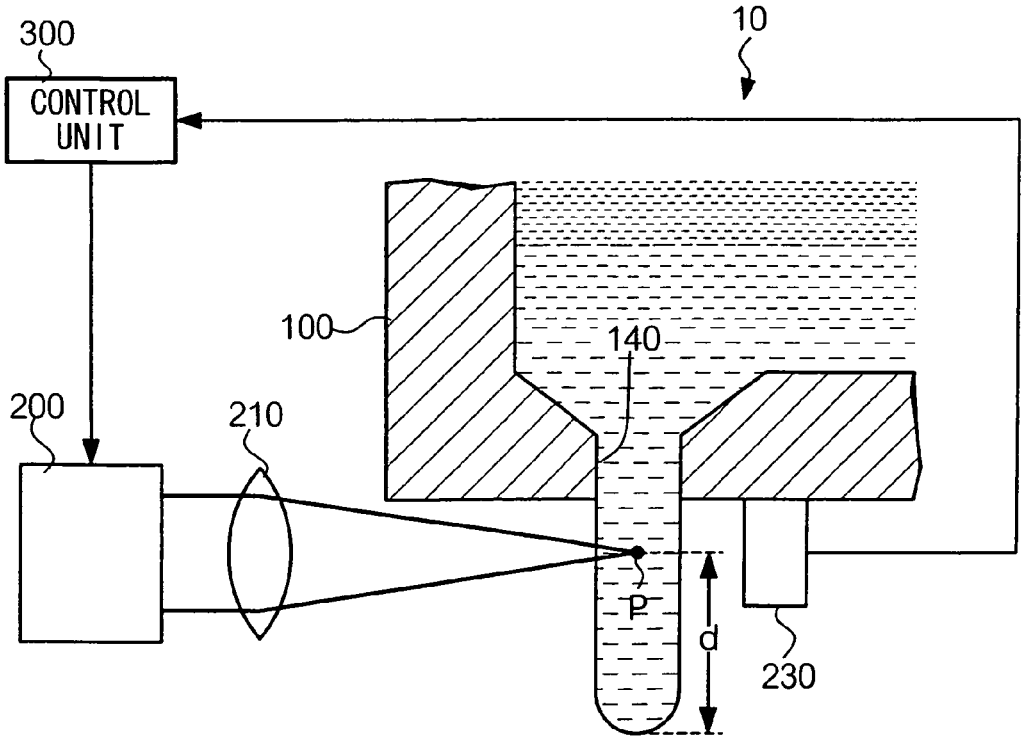
FIG. 4 is a diagram showing a peripheral configuration of a nozzle in the droplet ejecting device.

Subsequently, control unit 300 determines, on the basis of a clock signal supplied from the timer clock, whether a predetermined time period has elapsed since the point in time at which the head of the liquid column passes the concentration point P, while continuously ejecting the liquid column by means of piezoelectric element 130. As shown in FIG. 4, the predetermined time period is a period of time required for the liquid column to move downwardly over the distance "d" from the point in time at which the column head passes the concentration point P. The distance "d" represents a length of a liquid column, when a volume of the liquid contained the column reaches a volume of about 2 pl. The time required for the liquid column to be ejected over the distance "d" is a variable in time which is determined depending on a nozzle diameter and conditions in driving piezoelectric element 130 and can be predetermined empirically.

Figure 5A:
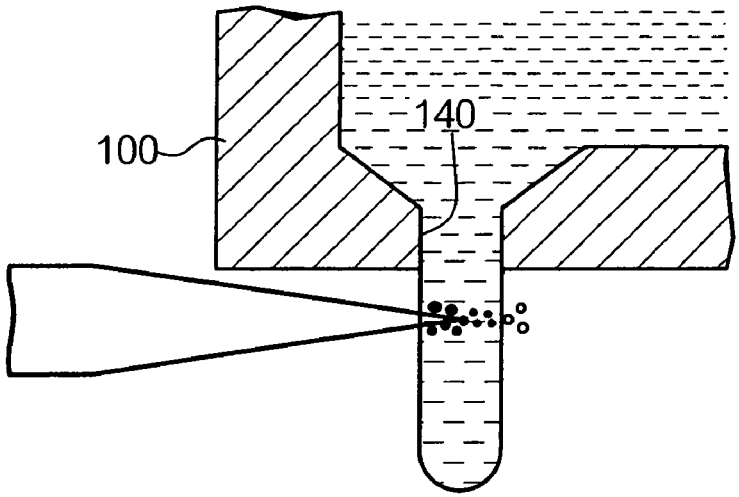
FIGS. 5A to 5C are diagrams showing that formation of a droplet from a liquid column is assisted.
Figure 5B:
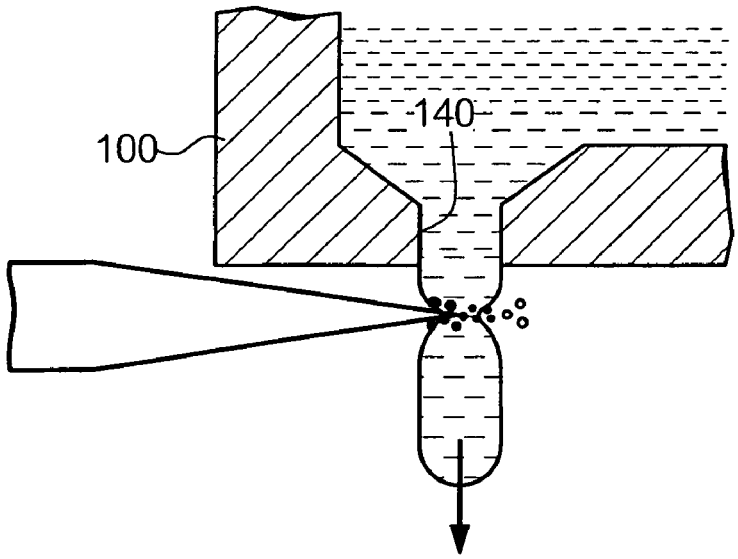
Figure 5C:
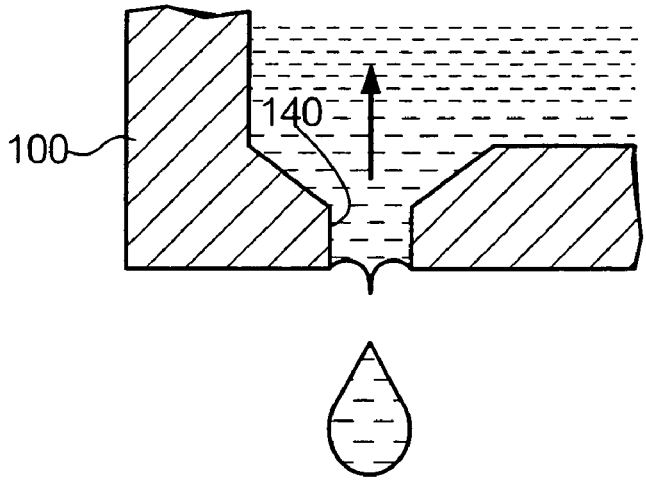

Upon determining that the predetermined time period has elapsed, control unit 300 stops ejecting the liquid column thereby maintaining the current amount of the liquid column being ejected, and switches the power of the laser beam emitted from laser 200 from low power to high power. When the level of the laser beam emitted is switched to high power, the liquid column is heated at the concentration point of the laser beam. As a result, as shown in FIG. 5A, any one of the following, or a combination of the following, is caused around the point of concentration, depending on a liquid type and the strength of the laser beam: generation of a bubble, a decrease in viscosity of the liquid or the scattering of the liquid due to the radiation pressure of the laser beam. Eventually, a necking is formed around the point of concentration as shown in FIG. 5B.

When enough time has elapsed to cause a necking in the liquid column after the laser beam is turned to high power, control unit 300 again switches the laser beam from a high to a low power. Control unit 300 then depressurizes the liquid in pressure chamber 120 and inhales a nozzle 140-side portion (i.e., the upper portion above the necking) of the liquid column into pressure chamber 120, which results in the separation of the liquid column at the necking by inertial force, and a droplet having a volume of 2 pl is ejected from ejecting head 100.

It is to be noted that the time required to cause a necking is a variable in time which depends on the viscosity or the temperature of the liquid and the power of the laser beam and may be empirically predetermined.

As has been described, droplet ejecting device 10 according to the present embodiment assists formation of a droplet from a liquid column by irradiating, outside pressure chamber 120, the liquid column ejected from pressure chamber 120 with a laser beam. In other words, the formation of a droplet from a liquid column by means of the push-and-pull operations is assisted by heating the liquid column by the laser beam energy or the radiation pressure of the laser beam. The device of the present invention enables reliable ejection of microscopic droplets even when a liquid has high viscosity.

Further, the operating speed of the pull-and-push operations may be decreased in comparison with the speed of a conventional technique for ejecting droplets only with the push-and-pull operations, since droplet ejecting device 10 assists the formation of a droplet from the liquid column. As a result, the ejecting speed of droplets is also decreased, thus minimizing the scattering of a droplet upon reaching a substrate.

In the present embodiment, the irradiation of a liquid column with a high-power laser beam is performed while ejection of the liquid column is being stopped by suspending the push-and-pull operations of the liquid column by means of piezoelectric element 130. However, the irradiation by the high-power laser beam may be started while a liquid column is being ejected. Further, the liquid column may be inhaled while the laser beam is being emitted.

On the other hand, microscopic droplets may be ejected from a liquid having high viscosity even when a conventional droplet ejecting device is being used if the viscosity is decreased. For example, when silver particles are contained in the liquid, the viscosity of the liquid may be decreased by reducing the percentage of silver particles contained in the liquid. However, there is an increased probability that particles will be scattered when droplets reach a substrate since the intermolecular force of a droplet is weak when the viscosity of a liquid is decreased.

As compared with the conventional device, droplet ejecting device 10 according to the present invention is capable of ejecting microscopic droplets regardless of the viscosity of a liquid being ejected. Therefore, the device 10 has an advantage of preventing droplets from scattering upon reaching a substrate because microscopic droplets can still be ejected even when the viscosity of the liquid is intentionally increased for the purpose of preventing droplets from scattering.

Further, droplet ejecting device 10 according to the present invention controls a timing at which a laser beam is emitted, thereby enabling the separation of droplets from a liquid column at a desired point. Specifically, the longer a time period is set for a high-level laser beam to start emitting, the larger a droplet can be formed. Thus, the size of a droplet may be readily controlled.

It is to be noted that the present invention is not limited to the above-described embodiment, but various modifications and improvements may be made thereto.

Figure 6:
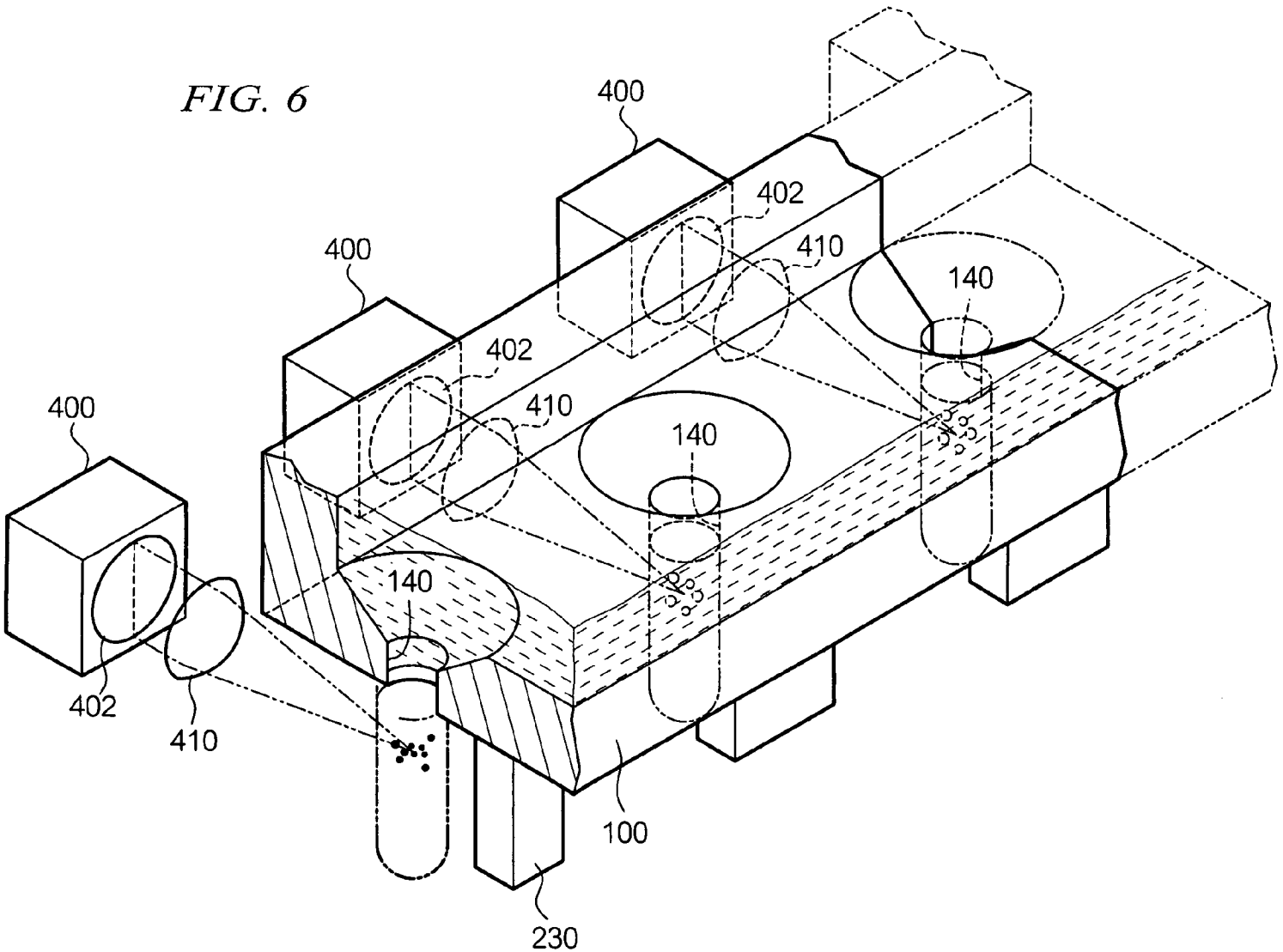
FIG. 6 is a perspective view of a laser and a lens according to a modification of the embodiment.

For example, in the above-described embodiment, a set of laser 200 and cylindrical lens 210 assists the formation of a droplet from a plurality of liquid columns in a collective manner. Alternatively, as shown in FIG. 6, a set of laser 400 and lens 410 may be provided individually to each nozzle 140. In the figure, laser 400 has a curved emitting surface 402 emitting laser beams. Lens 410 concentrates the laser beams emitted from laser 400 on a portion of a liquid column at which a necking is to be caused. Thus, providing a set of laser 400 and lens 410 for each nozzle 140 enables the control, for each liquid column, of a point or a timing at which the liquid column is separated.

Figure 7:
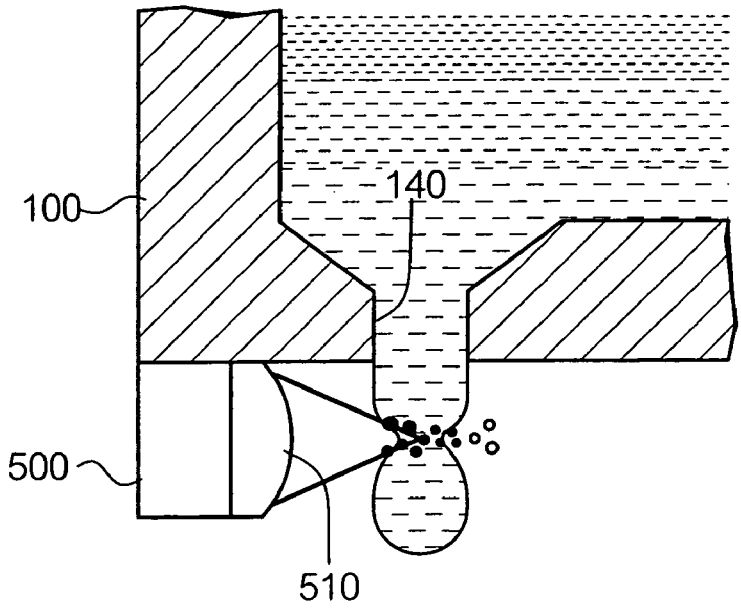
FIG. 7 is a diagram showing a peripheral configuration of a nozzle according to the modification.
Figure 8:
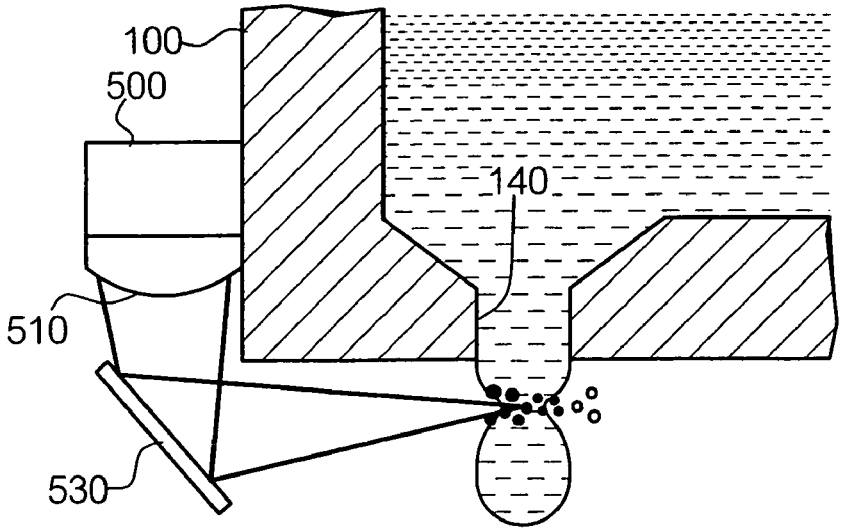
FIG. 8 is a diagram showing a peripheral configuration of a nozzle according to the modification.

Further, as shown in FIG. 7, a laser 500 including a cylindrical lens 510 may be provided so as to extend downwardly from ejecting head 100, while in the above embodiment, laser 200 and cylindrical lens 210 are provided as separate units. Having such a single-piece construction has an advantage of not requiring a special mechanism for supporting each laser 500 and cylindrical lens 510.

Where laser 500 cannot be provided under ejecting head 100 due to spatial limitations, a condensing type laser 500 may be mounted to the side surface of ejecting head 100 as shown in FIG. 8, by providing a reflecting member 530 under laser 500 for concentrating the laser beams on the liquid column.

Figure 9:
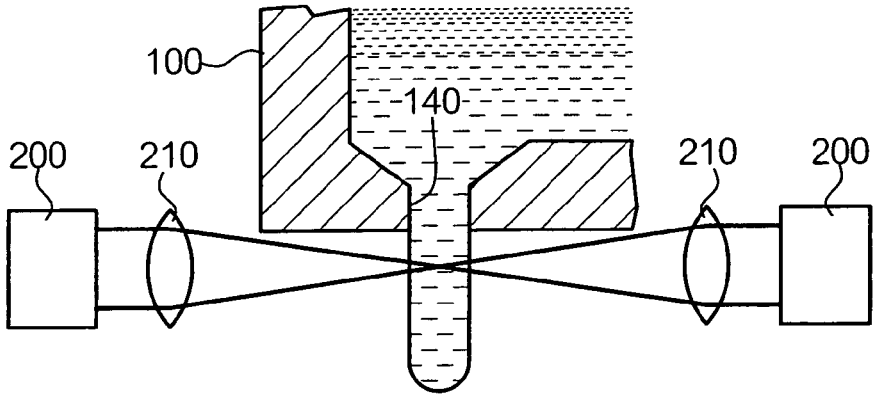
FIG. 9 is a diagram showing a peripheral configuration of a nozzle according to the modification.

Also in the above embodiment, a laser beam is emitted from a single direction toward a liquid column, thereby assisting formation of a droplet from a liquid column. However, when assisting the droplet formation from a single direction, a droplet may move in the direction of the movement of the laser beam due to radiation pressure generated by the laser beam. To prevent this, laser beams may be emitted from two opposite directions to a liquid column, as shown in FIG. 9, thereby assisting the droplet formation.

Figure 15:
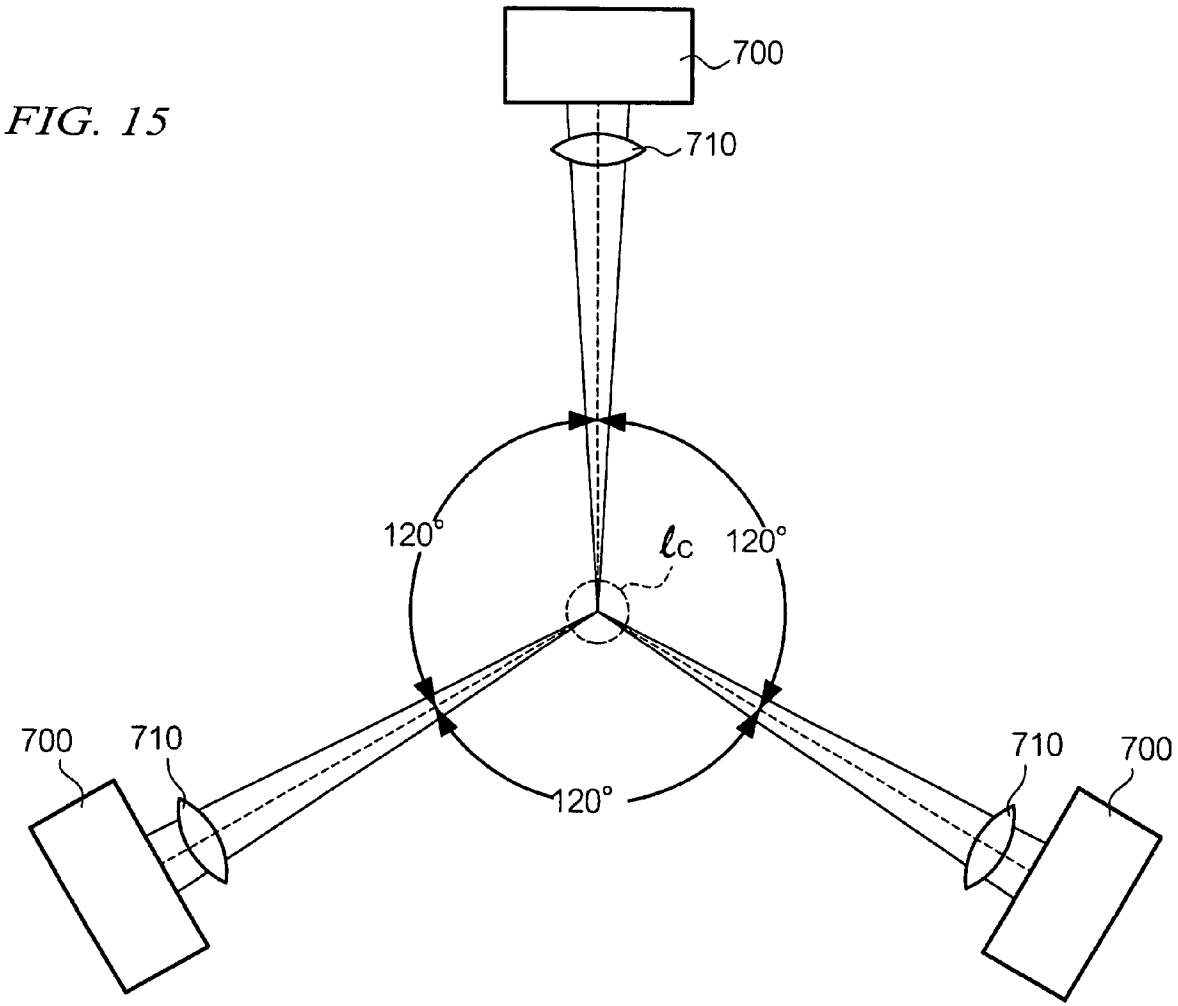
FIG. 15 is a diagram for describing a modification of the droplet ejecting device.

Alternatively to laser beams moving in opposite directions from one another, it should be obvious that more than one laser beam moving in different directions and emitted onto a liquid column should prevent a droplet from being misaligned due to the energy received from the laser beam, compared to the configuration of assisting droplet formation by using a laser beam moving in a single direction. FIG. 15 shows an example configuration for assisting droplet formation by means of laser beams moving in three directions. In the figure, there are shown three laser beams emitted horizontally from three lasers 700, respectively, looking down on the laser beams along the vertical axis of a liquid column 1*c*. Three lasers 700 are positioned so that an optical axis along the moving direction of a laser beam emitted from a laser 700 forms a 120-degree angle to an optical axis along the moving direction of a laser beam emitting from a neighboring laser 700. Further, three lenses 710 concentrate the laser beam emitted from each laser 700 at one point of liquid column 1*c* while maintaining each optical axis.

Thus, laser beams being emitted from three directions may prevent a misalignment of a droplet due to the energy of the laser beam, compared to the configuration of assisting a droplet formation by using a laser beam moving in a single direction. More preferably, the misalignment of the droplet caused by the applied energy of a laser beam may be reduced to almost nothing by adjusting the laser beam strength and/or the distance from the laser emitting surface to a concentration point of the beam in such a way that the energy generated from a plurality of laser beams balance one another (in other words, forces applied to the liquid column balance each other out.)

Figure 10:
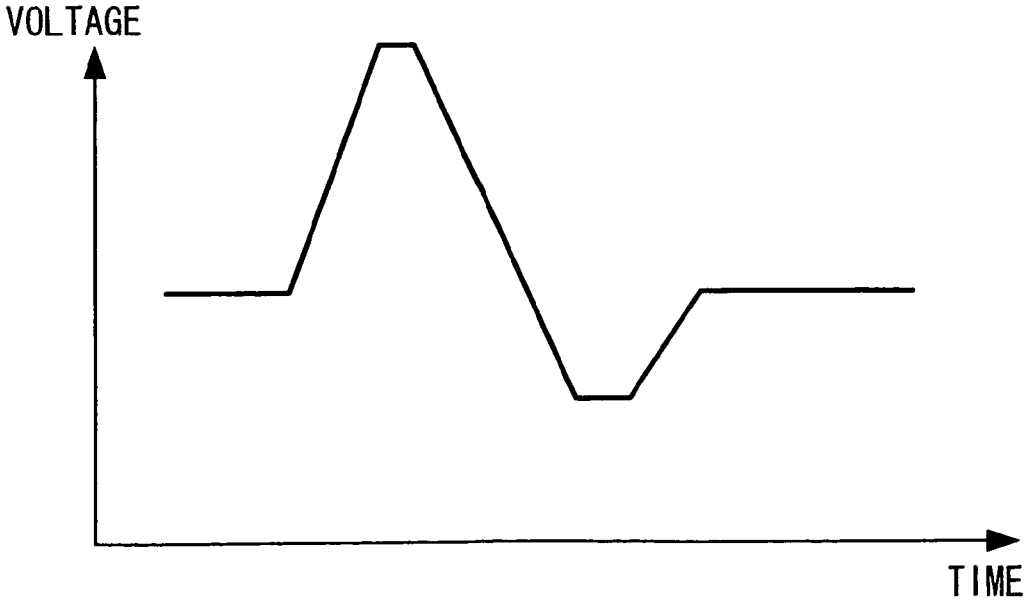
FIG. 10 is a diagram showing a drive signal for a piezoelectric element according to the modification.

In the above-described embodiment, a timing at which a high-power laser beam is emitted to the liquid column is determined depending on the presence or absence of the reception signal RS supplied from photoreceptor 230, but the present invention is not limited thereto. For example, the protruded distance of a liquid column may be estimated based on timing information as to when driving signals are supplied to piezoelectric element 130 as shown in FIG. 10, and a high-power laser beam may be emitted to the liquid column on the basis of the estimation. It should be noted that the relations between driving signals and a protruded distance of a liquid column may be obtained empirically. Also, since the present modification does not require the detection of a starting point at which a liquid column starts to be ejected, only a high-power laser beam is emitted from laser 200.

Further, while the above-described liquid ejecting device 10 assists droplet formation by means of a laser beam, the laser beam is not the only means for assisting the formation of a droplet. Non-coherent light may also be used if the energy density and the light-condensing characteristics are sufficiently high.

Figure 11:
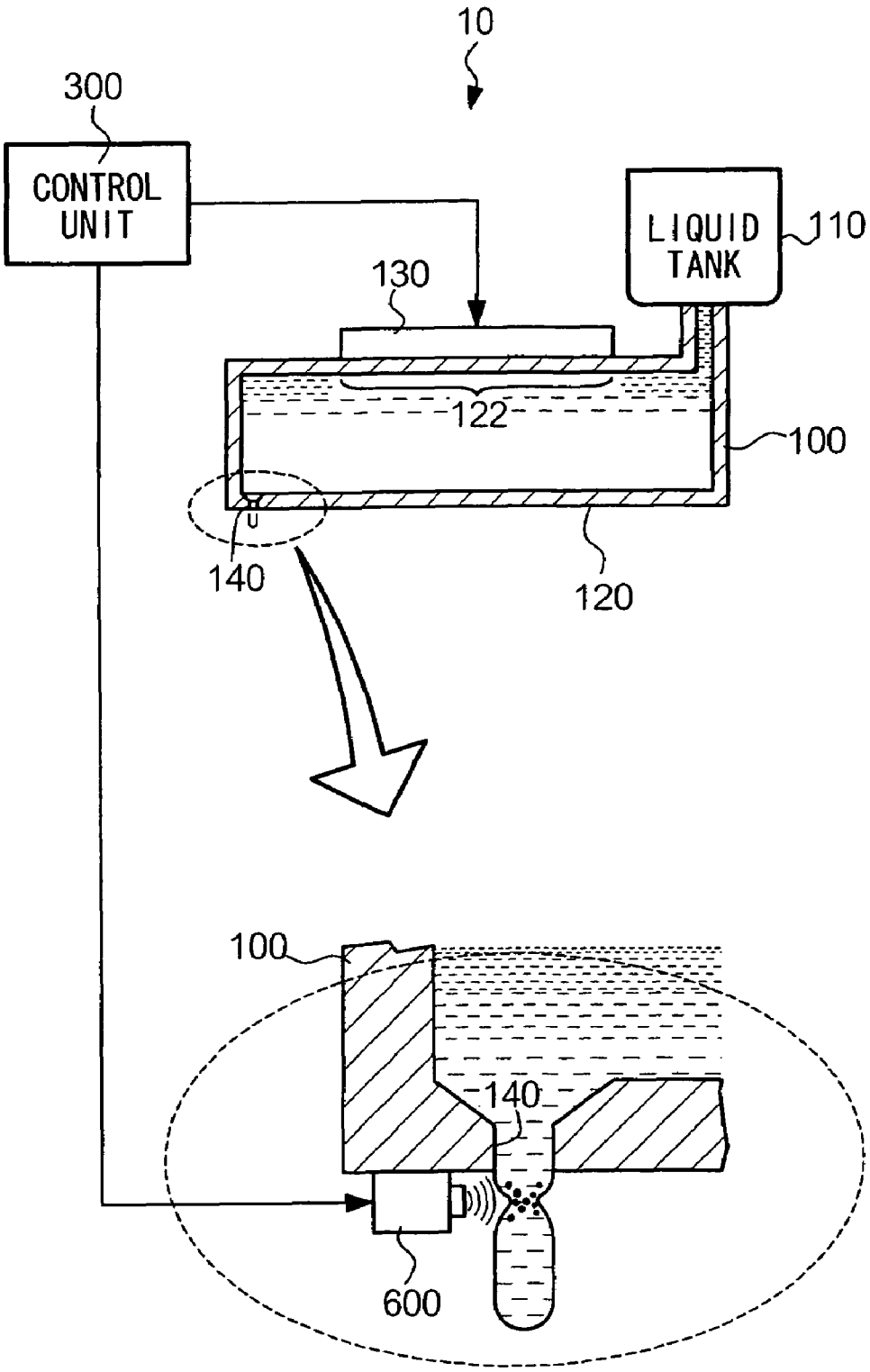
FIG. 11 is a diagram showing a peripheral configuration of an ejecting head according to the modification.
Figure 12A:
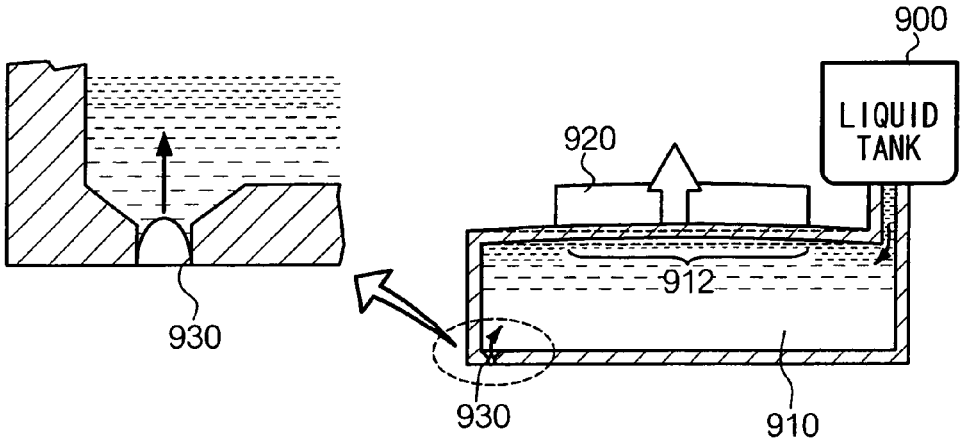
FIGS. 12A to 12C are diagrams for describing a conventional droplet ejecting device.
Figure 12B:
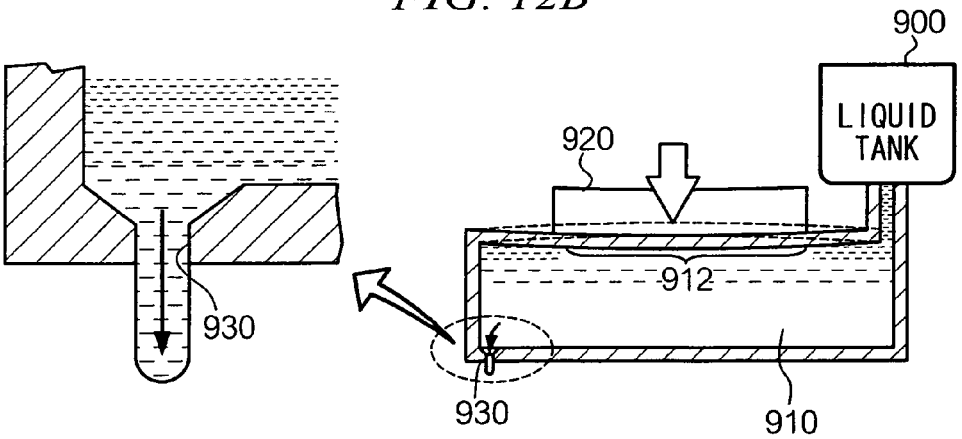
Figure 12C:
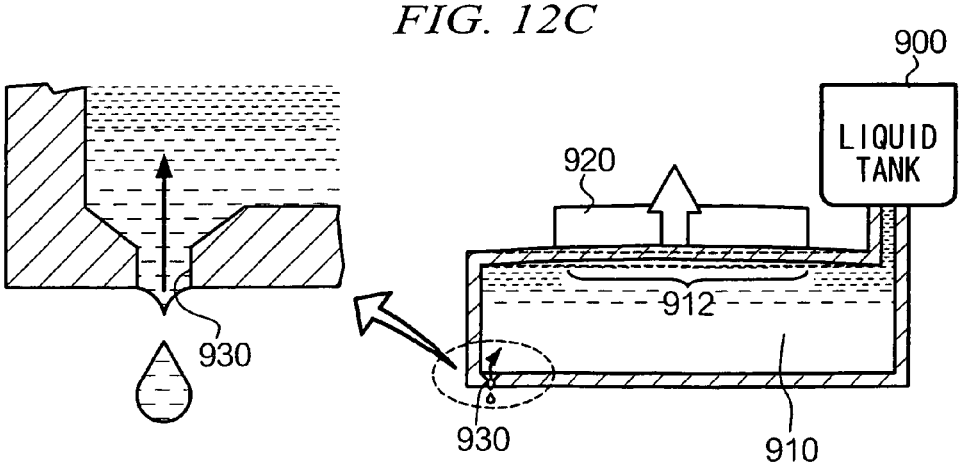
Figure 13A:
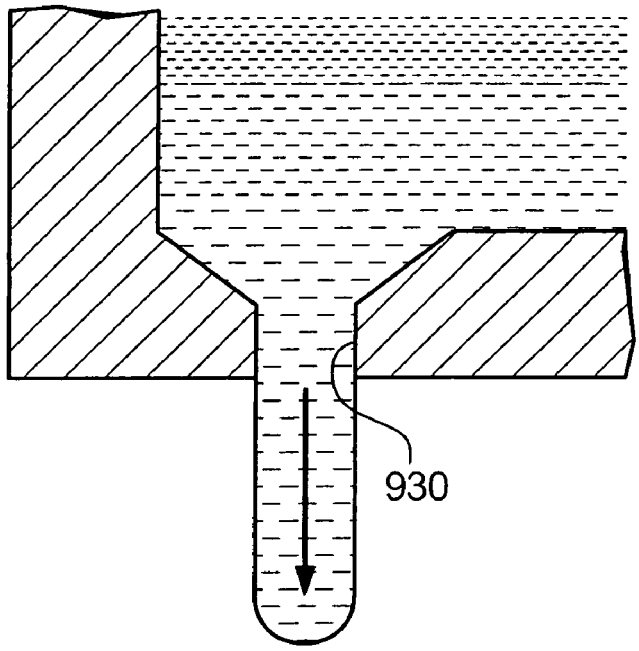
FIGS. 13A and 13B are diagrams for describing a conventional droplet ejecting device.
Figure 13B:
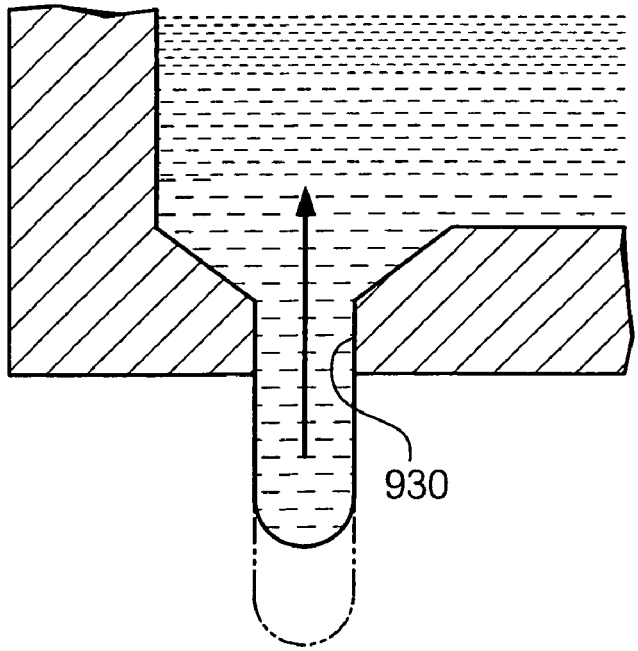

Also, as shown in FIG. 11, a heater 600 may be used to assist the formation of a droplet. In the figure, heater 600 applies the heat locally at a separation point of a liquid column protruded from nozzle 140. As a result, in the same way as in the case of heating the column using a laser beam, not only are air bubbles generated at the heated portion but the viscosity of the column is also decreased, and the reliable formation of a droplet from a liquid column is enabled even when the liquid is of a high viscosity. Thus, the energy used for assisting the droplet formation is not limited to optical energy; thermal energy or other types of energies may be used.

It is to be noted that a droplet ejecting device 10 under a configuration having a heater does not need to comprise a laser 200 and a photoreceptor 230. Thus, a timing for applying heat to a liquid column using heater 600 may be determined by estimating the protruded distance of the liquid column based on timings at which driving signals are supplied to piezoelectric element 130 (refer to FIG. 10).

Further, piezoelectric element 130 is not the only means for increasing pressure on the liquid in pressure chamber 120 of ejecting head 100. For example, air bubbles may be generated by heating a part of the liquid in pressure chamber 120 to the boiling point of the liquid, so that the liquid in pressure chamber 120 is subject to increased pressure by means of the air bubbles developed by such heating. Any other means may also be used to pressurize the liquid in pressure chamber 120 if it causes a liquid column to protrude from a nozzle by increasing the pressure in the liquid in pressure chamber 120.

<Applications of Droplet Ejecting Device 10:>

In the following, applications of the above droplet ejecting device 10 will be explained.

As has been described, droplet ejecting device 10 is well suited for application to the manufacturing of various elements used in the electronic device or electronic optical device since the device 10 is capable of ejecting, with high reliability, liquid containing functional materials as microscopic droplets. Those elements that are well suited for manufacturing using droplet ejecting device 10 include a RFID (Radio Frequency Identification) tag, an electron emission element, a microlens, a color filter, an organic EL element, a plasma display device, and the like. Hereinafter, a description will be given of methods for manufacturing the listed products using droplet ejecting device 10.

<Method for Manufacturing a RFID Tag:>

Figure 14:
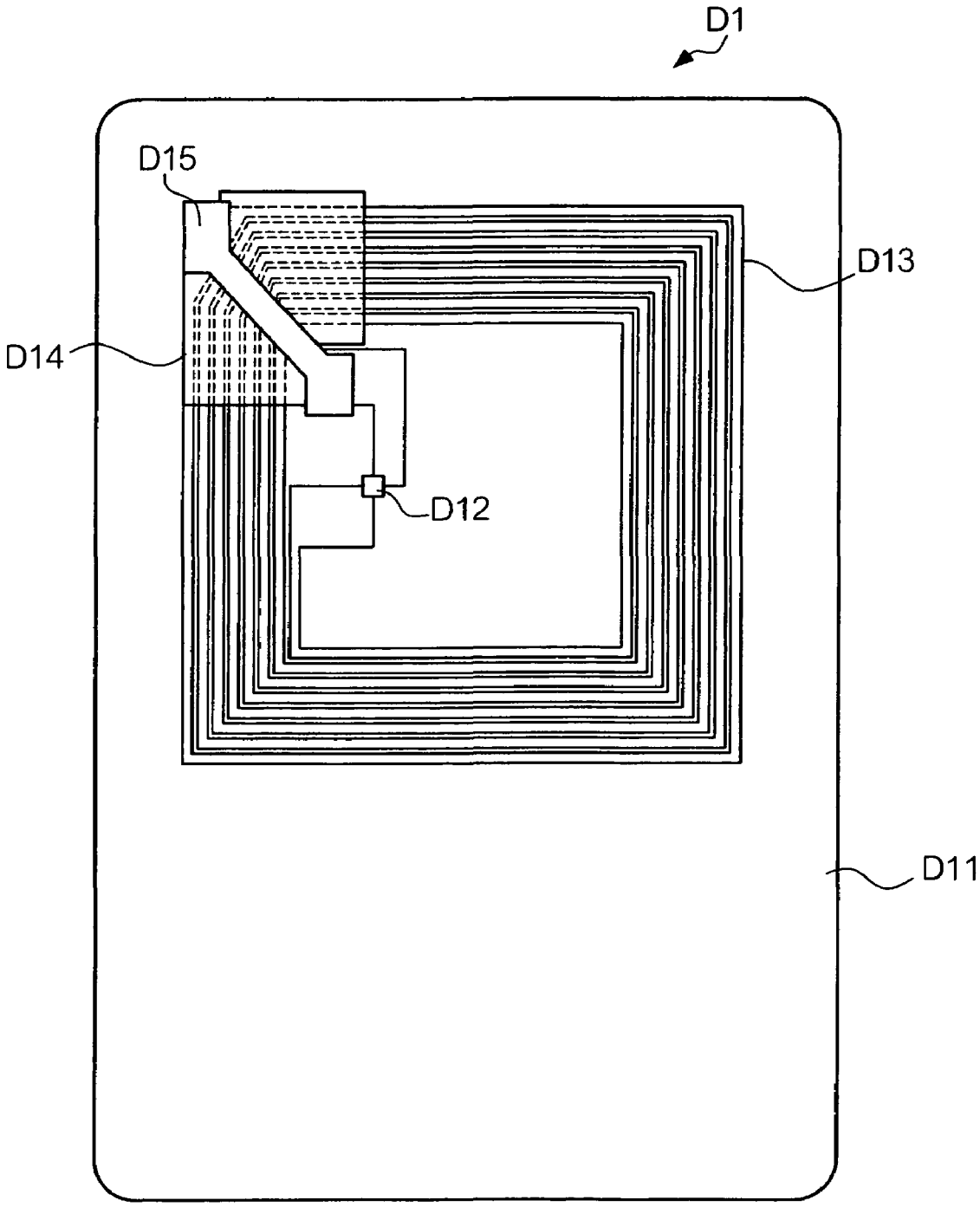
FIG. 14 is a diagram for describing a method for manufacturing a RFID (Radio Frequency Identification) tag using the droplet ejecting device according to the embodiment.

FIG. 14 shows a diagram showing a RFID tag D1 with a wiring patterned using droplet ejecting device 10. RFID tag D1 is an electronic circuit for use in a radio identification system, and generally provided in IC (integrated circuit) cards. More specifically, there are provided on RFID tag D1 an integrated circuit (IC) D12 provided on a surface of a PET (polyethylene terephthalate) substrate D11, an antenna D13 that is spiral shaped and connected to integrated circuit D12, a solder resist D14 mounted on a part of antenna D13, and a connection wire D15 that is formed on solder resist D14 for connecting both ends of antenna D13 to form a loop. Among these components, antenna D13 is patterned using droplet ejecting device 10. In other words, antenna D13 is patterned with high accuracy with microscopic droplets, and has less possibility of causing a short-circuit.

<Method for Manufacturing an Electron Emission Element:>

Next, a description will be given of a method for manufacturing an emitter substrate having an electron emission element.

Figure 16A:
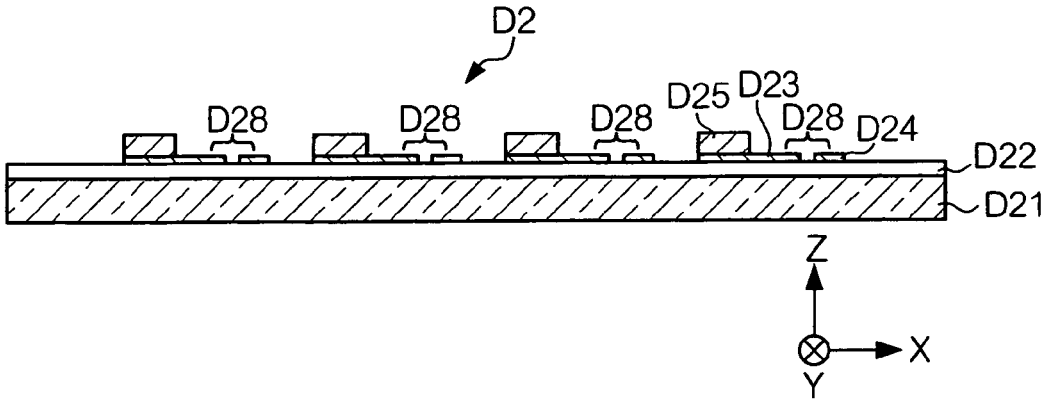
FIGS. 16A and 16B are diagrams for describing a method for manufacturing an electron emission element using the droplet ejecting device.
Figure 16B:
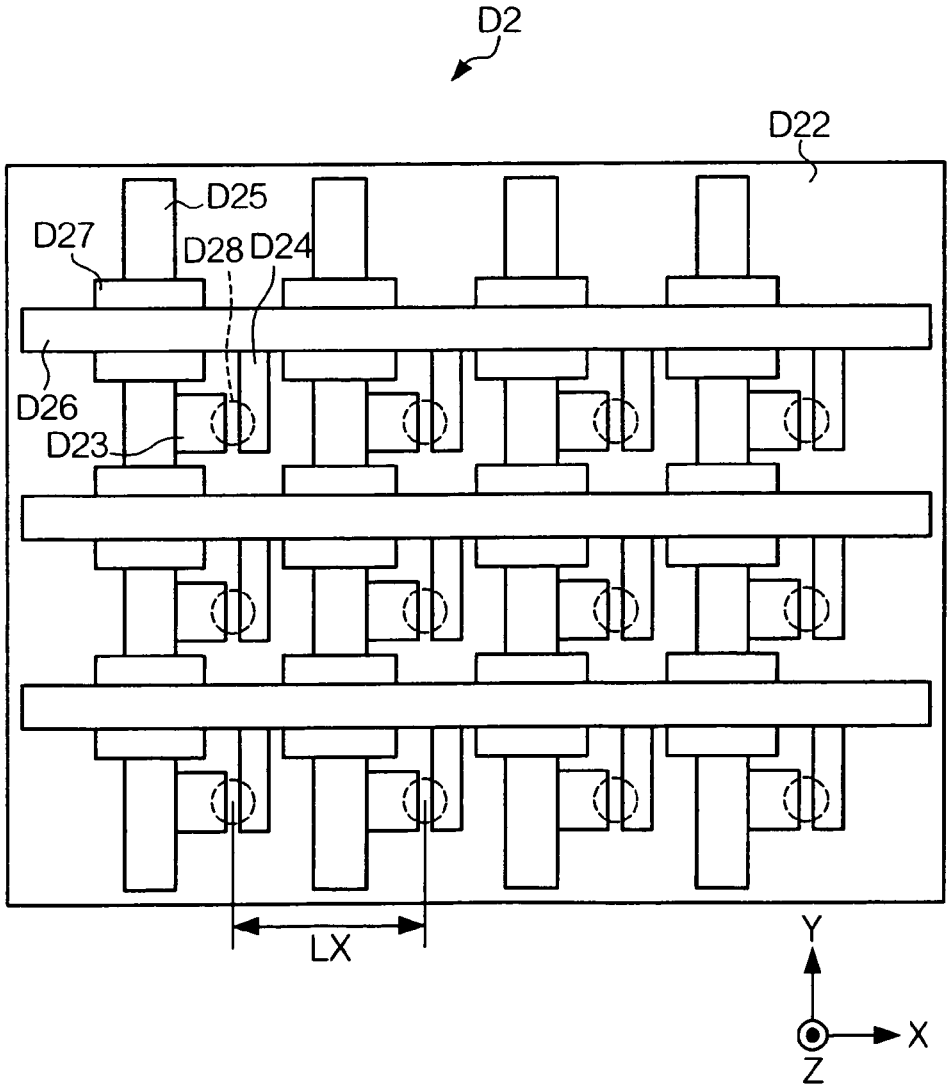

FIGS. 16A and 16B are diagrams showing a configuration of an emitter substrate in a process of manufacturing. Specifically, FIG. 16A is a side view of an emitter substrate D2 immediately before a conductive thin film is formed using a droplet ejecting device; and FIG. 16B is a top view of the same emitter substrate D2.

As shown in the figures, emitter substrate D2 comprises a substrate D21 formed of soda glass. There is laminated on substrate D21 a sodium diffusion preventing layer D22 having silicon dioxide (SiO2) as its main component. Sodium diffusion preventing layer D22 is formed using, for example, a sputtering method to form a layer having a thickness of approximately 1 μm.

Element electrodes D23 and D24 are titanium layers formed on sodium diffusion preventing layer D22 having a thickness of, for example, 5 nm. These element electrodes D23 and D24 are formed through a layer forming process of a titanium layer using, for example, a sputtering method or a vacuum evaporation method, and a molding process of the titanium layer using a photo lithography and an etching. Element electrodes D23 and D24 thus formed are arranged in a matrix on sodium diffusion preventing layer D22.

A metal wiring D25 is a strip-shaped electrode extending in the direction of Y in the figure, and a plurality of metal wirings D25 are formed so that each wiring D25 covers a portion of each of a plurality of element electrodes D23 that are arranged in a row in the direction of Y in the figure. These metal wirings D25 are formed through a process of applying a silver (Ag) paste using, for example, a screen printing technique and a process of firing the applied silver paste. An insulator layer D27 is an insulator such as glass and is arranged in a matrix so as to cover metal wiring D25 widthwise (in the direction of X in the figure). Insulator layer D27 is formed, in the same way as metal wiring D25, through a process of applying glass paste, for example by a screen printing technique and a process of firing the applied glass paste.

A metal wiring D26 is a strip-shaped electrode extending in the direction of X in the figure so as to cross metal wiring D25. A metal wiring D26 covers a portion of each of a plurality of element electrodes D24 arranged in a row in the direction of X in the figure. Metal wiring D26 also straddles a plurality of insulator layers D27 in the direction of X. Metal wiring D26 is made, for example, of silver, and formed by means of a screen printing technique as in the case of metal wiring D25.

An area including a pair of an element electrode D23 and an element electrode D24 adjacent to each other corresponds to a pixel area. In a pixel area, element electrode D23 is electrically connected to a corresponding metal wiring D25; and element electrode D24 is electrically connected to corresponding element electrode D26. It is to be noted that metal wirings D25 and D26 are insulated from each other by insulator layers D27.

In each pixel area, a conductive thin film is formed by the droplet ejecting device 10 in an area D28 including a portion of element electrode D23, a portion of element electrode D24, and an exposed portion of sodium diffusion preventing layer D22 between element electrodes D23 and D24. These areas D28 (hereinafter referred to as "coating area(s) D28") are arranged in a matrix on emitter substrate D2, and a pitch LX or a distance between two adjacent coating areas D28 is approximately 190 μm. The pitch LX is almost the same as the pitch adopted in a high-vision television with a screen of about 40 inches.

A description will be further given of a process of forming a conductive thin film in each coating area D28 using droplet ejecting device 10. First, it is desirable to cause emitter substrate D2 to be hydrophilic. Making emitter substrate D2 hydrophilic helps a droplet to become established on coating area D28. Substrate D2 may be made hydrophilic using, for example, an atmospheric-pressure oxygen plasma process.

Figure 17A:
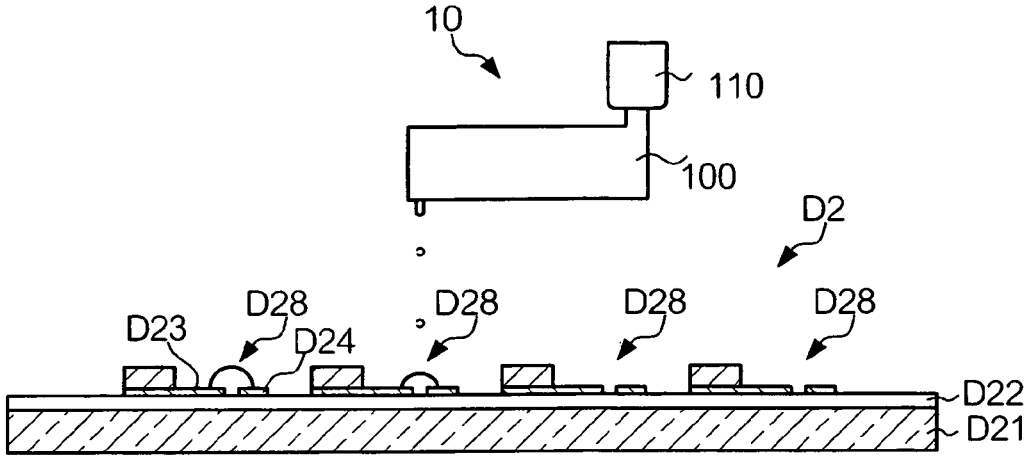
FIGS. 17A to 17C are diagrams for describing a method for manufacturing the electron emission element using the droplet ejecting device.
Figure 17B:
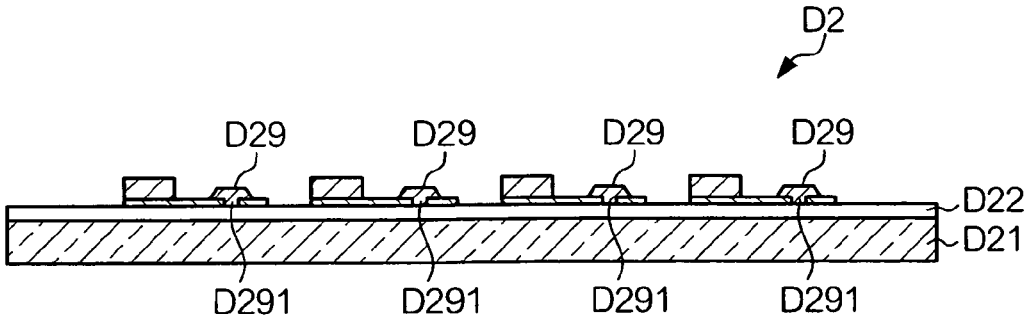

Subsequently, as shown in FIG. 17A, a droplet including conductive materials such as organic palladium solution is ejected onto each coating area D28 of emitter substrate D2, using droplet ejecting device 10. As explained in the foregoing description of the embodiment, droplet ejecting device 10 ejects a droplet while assisting the formation of a droplet using a laser beam. Thus, conductive materials can be applied to each coating area D28 with high precision when droplet ejecting device 10 is used.

When the applied conductive materials become dry, conductive thin films D29 having oxided palladium as their main element are formed on coating areas D28. Conductive thin film D29 is formed, in each pixel area, so as to cover a portion of element electrode D23, a portion of element electrode D24, and an exposed portion of sodium diffusion preventing layer D22 between the electrodes D23 and D24.

When pulse voltage is applied between element electrodes D23 and D24, a portion D291 of conductive thin film D29 is caused to become an electron emitter which emits electrons. It is to be noted that the voltage may be applied to each of element electrodes D23 and D24, preferably in an organic atmosphere and in a vacuum for the purpose of enhancing electron emission efficiency from the electron emitter.

Thus created element electrodes D23 and D24 and conductive thin film D29 having an electron emitter in each pixel area are caused to function as electron emission elements.

Figure 17C:
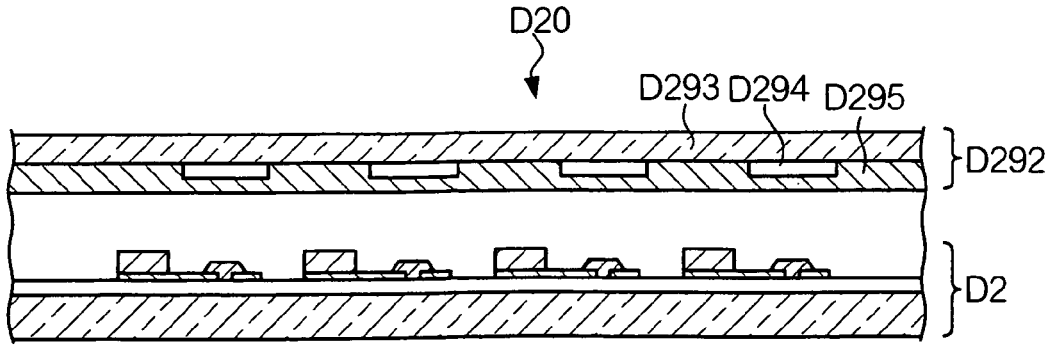

An electronic optical device D20 such as shown in FIG. 17C is obtained by putting together emitter substrate D2 with the electron emission elements having been formed and a front substrate D292. Front substrate D292 has a glass substrate D293, a plurality of fluorescent units D294 mounted to glass substrate D293 each unit D294 corresponding to each pixel area, and a metal plate D295. Metal plate D295 functions as an electrode for accelerating an electron beam emitted from the electron emitter of conductive thin film D29. Glass substrate D293 is positioned so as to become an outer surface of front substrate D292, and the substrate D292 is positioned so that each fluorescent unit D294 faces one of the electron emission elements of each conductive thin film D29. Further, spaces between emitter substrate D2 and front substrate D292 are maintained in a vacuum.

<Method for Manufacturing a Microlens:>

Figure 18A:
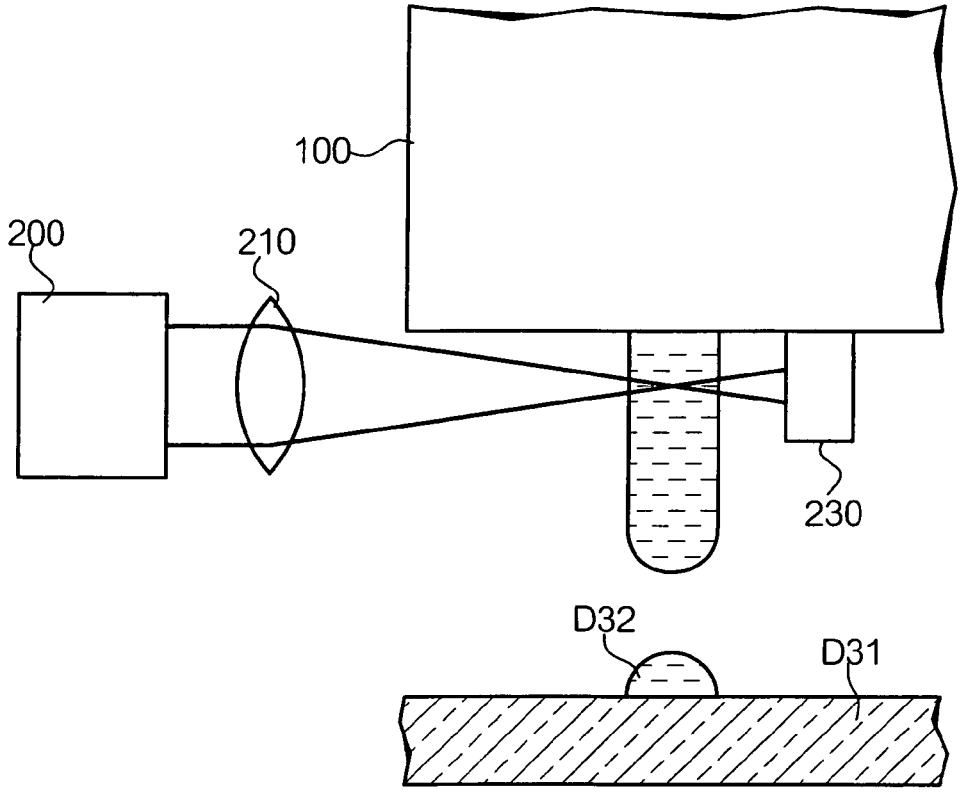
FIGS. 18A and 18B are diagrams for describing a method for manufacturing a microlens using the droplet ejecting device.

FIGS. 18A, 18B, 19A, and 19B are diagrams showing a process of manufacturing a microlens using droplet ejecting device 10 according to the above embodiment. First, as shown in FIG. 18A, a droplet containing a light-transparent resin is ejected from ejecting head 100 onto a substrate D31, while formation of the droplet is assisted by a laser beam. Light-transparent resins may be a simple substance or a mixture of thermoplastic resin or thermosetting resin such as acrylic resin, allyl resin, methacrylic resin, and the like. The light-transparent resins contained in a droplet may also include radiation-hardening-type light-transparent resins combined with a photopolymerization initiator such as biimidazolate compound. Radiation-hardening-type light-transparent resins generally comprise characteristics of becoming hard when exposed to radiation such as ultra violet rays. It is assumed in the present application that a droplet ejected from droplet ejecting device 10 is a radiation-hardening-type resin that is hardened by ultra violet rays. Where a droplet ejected from ejecting head 100 has a light-hardening characteristic of being hardened by a particular type of light, such as in the present application, a laser beam emitted from laser 200 preferably does not include the particular type of light (i.e. "ultra violet rays" in the case of the present application).

Substrate D31 may be a light-transparent sheet made of light-transparent material such as cellulosic resin, polyvinyl chloride, or the like, when manufacturing a microlens for use as an optical film for screens.

When the droplet ejected from ejecting head 100 adheres to substrate D31, droplet D32 is caused to be dome-shaped as shown in FIG. 18A as a result of the action of surface tension. In the meantime, the droplet D32 is caused to become microscopic as its formation is assisted by a laser beam.

Figure 18B:
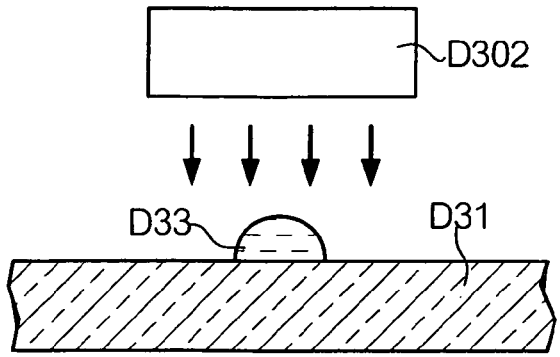

Next as shown in FIG. 18B, ultra violet rays are emitted from an ultra violet ray emitting unit D302 to droplet D32 of FIG. 18A that has adhered to substrate D31. The dome-shaped droplet D32 is then caused to be hardened and to become a hardened resin D33.

Figure 19A:
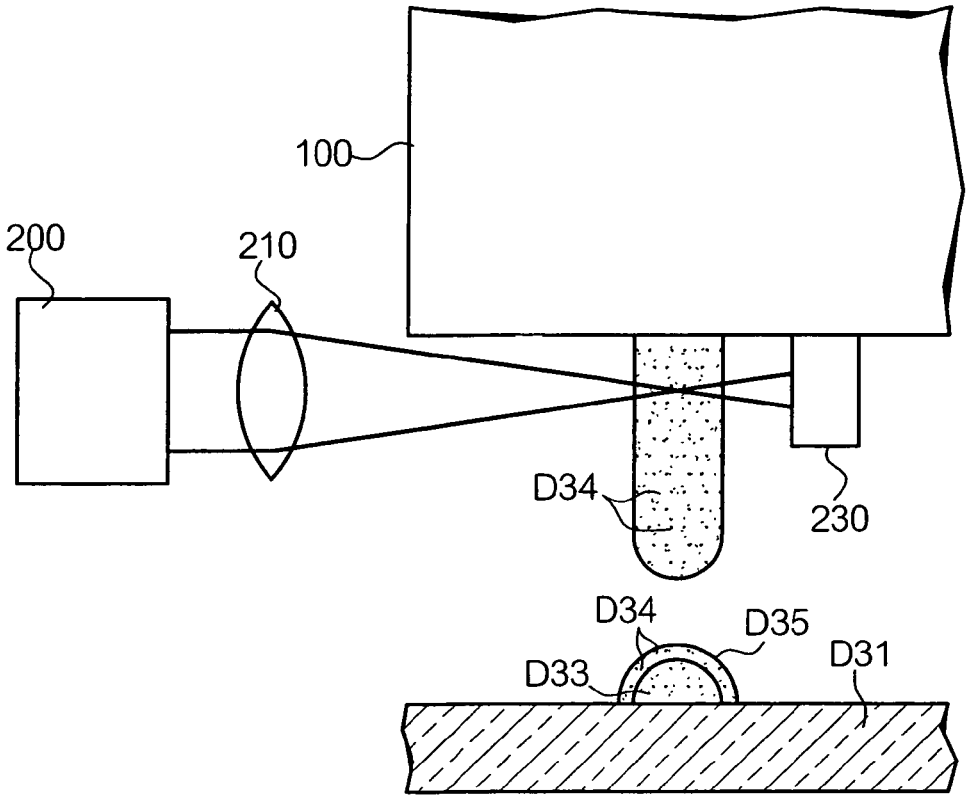
FIGS. 19A and 19B are diagrams for describing a method for manufacturing the microlens using the droplet ejecting device.

Subsequently, as shown in FIG. 19A, another droplet containing light-diffusion type particles D34 is ejected from ejecting head 100 onto hardened resin D33, while the formation of a droplet is assisted by a laser beam. Such light-diffusion type particles D34 may be silica, alumina, titania, calcium carbonate, aluminum hydroxide, acrylic resin, organic silicon resin, polystyrene, urea resin, formaldehyde condensate, or the like. Light-diffusion type particles D34 are dispersed in a solvent (e.g., a solvent used for the light-transparent resins) and converted to a liquid state thereby enabling their ejection from ejecting head 100.

Figure 19B:
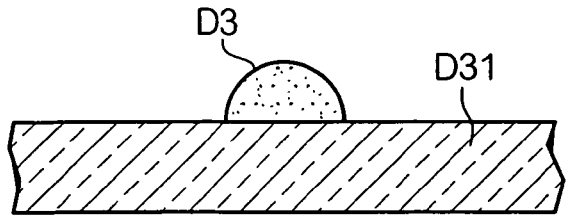

As shown in FIG. 19A, the droplet ejected from ejecting head 100 adheres to the surface of the hardened resin D33, and the hardened resin D33 is caused to be covered by solution D35 containing light-diffusion particles D34. The hardened resin D33 covered with solution D35 is then subjected to heating, decompression, or heating and decompression, which causes the solvent contained in solution D35 to evaporate. The hardened resin D33 is once softened near its surface due to the solvent contained in solution D35, but becomes hardened again after the solvent evaporates. As a result, a microlens D3 is formed, as shown in FIG. 19B, the microlens having light-diffusion particles D34 dispersed near its surface.

Figure 20:
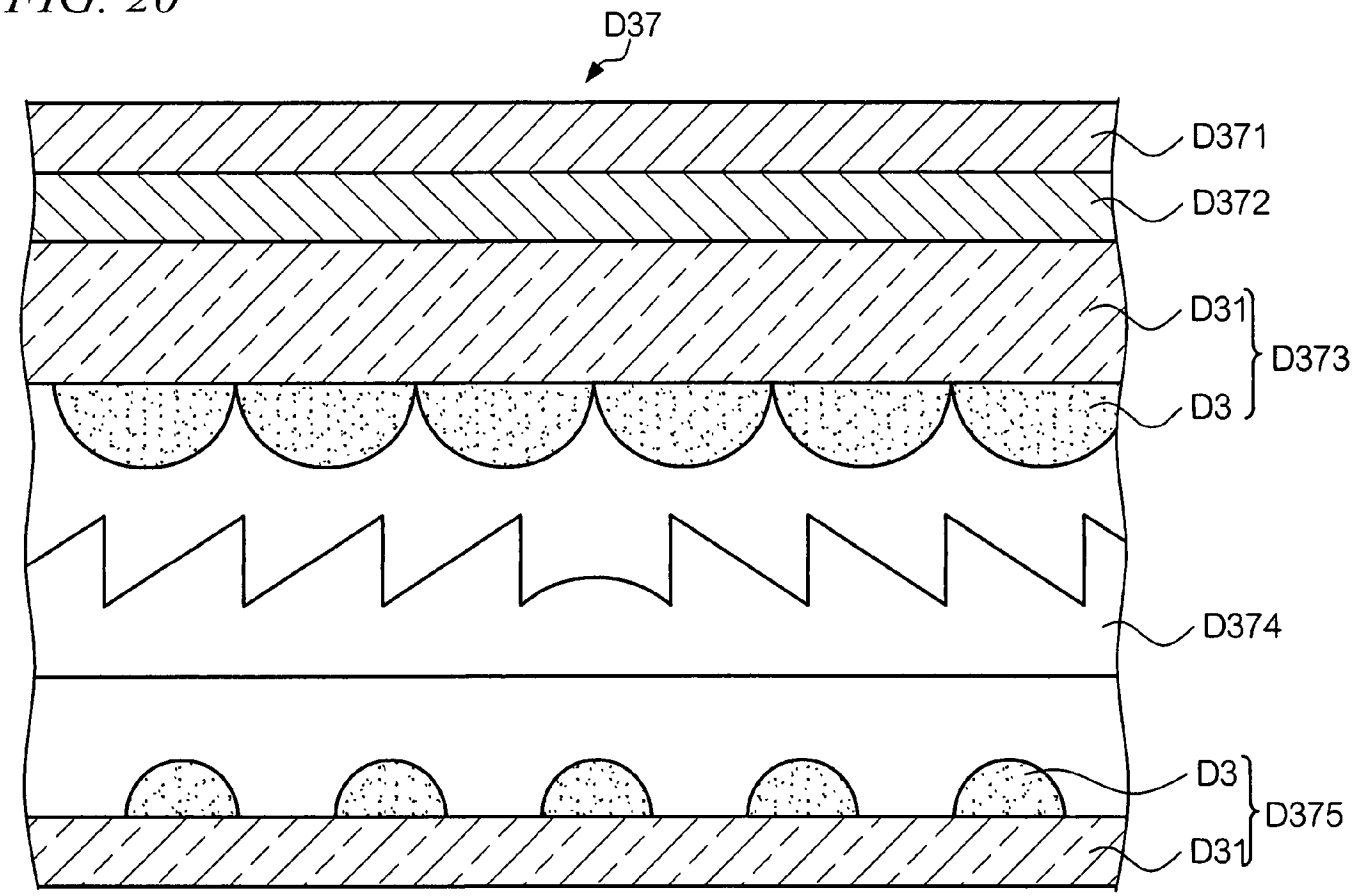
FIG. 20 is a cross-sectional view of a microlens screen comprising the microlens.

A description is further given of a screen for a projector having the microlens D3 thus formed. FIG. 20 is a cross-sectional view of a screen having a microlens D3. Screen D37 is made of a film substrate D371, an adhesive layer D372, a lenticular sheet D373, a Fresnel lens D374, and a scattering film D375 being laminated in the listed order.

The lenticular sheet D373 and scattering film D375 each comprise a microlens D3 manufactured using the above-described method. Specifically, a plurality of microlenses D3 is mounted to a substrate D31 for each of the lenticular sheet D373 and scattering film D375, but more densely on the substrate D31 for the lenticular sheet D373. The size and/or the number of microlenses D3 to be included in each of the lenticular sheet D373 and scattering film D375 is determined so that the substrate area of the lenticular sheet D373 is more densely covered by microlenses D3 than the substrate area of the scattering film D375.

<Method for Manufacturing a Color Filter:>

FIGS. 21A to 21C and 22A and 22B are diagrams illustrating how a color filer is manufactured using droplet ejecting device 10 according to the above embodiment.

Figure 21A:
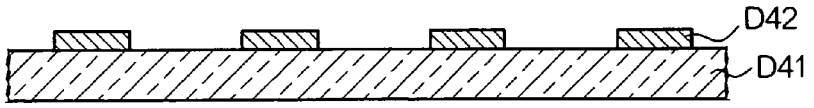
FIGS. 21A to 21C are diagrams for describing a method for manufacturing a color filter using the droplet ejecting device.

As shown in FIG. 21A, a black matrix D42 is first formed on a substrate D41. Black matrix D42 is a lightproof thin film, with chromium metal, resinous black matrix materials, or the like having been patterned. Where black matrix D42 is formed of chromium metal, a sputtering or a vapor deposition method may be used.

Figure 21B:
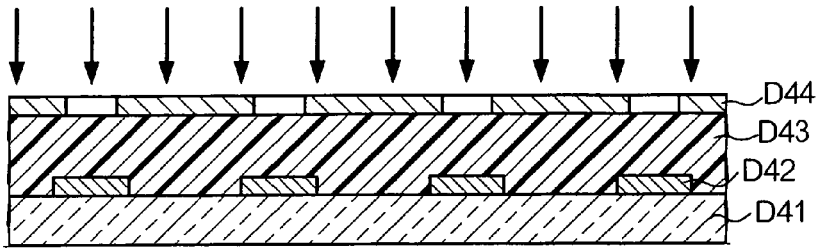
Figure 21C:
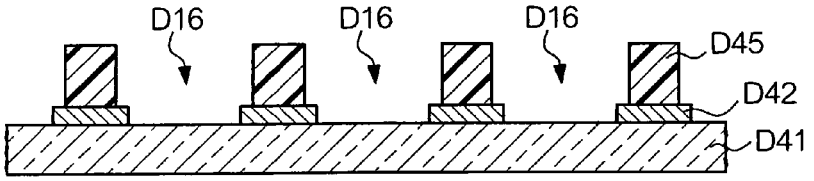

A bank D45 is subsequently formed on the black matrix D42 such as shown in FIG. 21C. To form the bank D45, a resist layer D43 is laminated over the substrate D41 and the black matrix D42, as shown in FIG. 21B. The resist layer D43 is a negative-type photo sensitive resin and is of light-hardening characteristic. The top surface of the resist layer D43 is then exposed to light, while covering the surface with a mask film D44. The unexposed portions of the resist layer D43 are then subjected to an etching treatment, thereby forming the bank D45 shown in FIG. 21C. Bank D45 and black matrix D42 function as a partition for a color layer that selectively transmits red, green, and blue lights. The color layer is formed using droplet ejecting head 10 according to the above embodiment in such a way as described below.

Figure 22A:
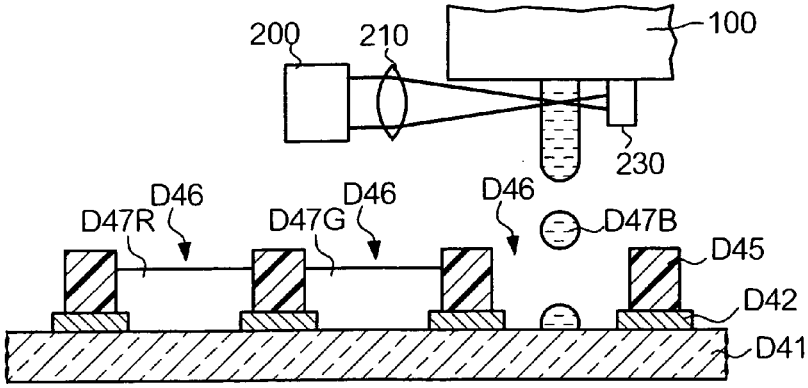
FIGS. 22A and 22B are diagrams for describing a method for manufacturing the color filter using the droplet ejecting device.

As shown in FIG. 22A, a red, green, or blue ink droplet is selectively ejected by droplet ejecting device 10 onto an area partitioned by banks D45 and black matrixes D42. Specifically, droplet ejecting device 10 has three liquid tanks 110, each storing red, green, and blue ink, respectively, as well as three ejecting heads 100 for ejecting ink supplied from respective liquid tanks 110 as an ink droplet. Also, droplet ejecting device 10 is provided with a trio of a laser 200, a cylindrical lens 210, and a photoreceptor 230 for each ejecting head 100.

The droplet ejecting device 10 having the above configuration selectively ejects red ink D47R, green ink D47G, or blue ink D47B as an ink droplet onto an area D46 partitioned by banks D45 and black matrixes D42. Droplet ejecting device 10 assists the ejection of an ink droplet by a laser beam. It is to be noted that FIG. 22A shows blue ink D47B being ejected.

Figure 22B:
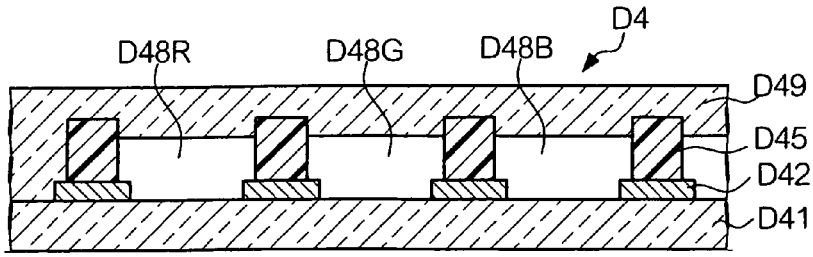

Once the ink droplets of each color thus applied become dry, a red color layer D48R, a green color layer D48G, and a blue color layer D48B are formed as shown in FIG. 22B. A protection layer D49 is then formed as shown in the figure so as to cover banks D45 and color layers D48R, D48G, and D48B; thus, a color filter D4 is finished.

Figure 23:
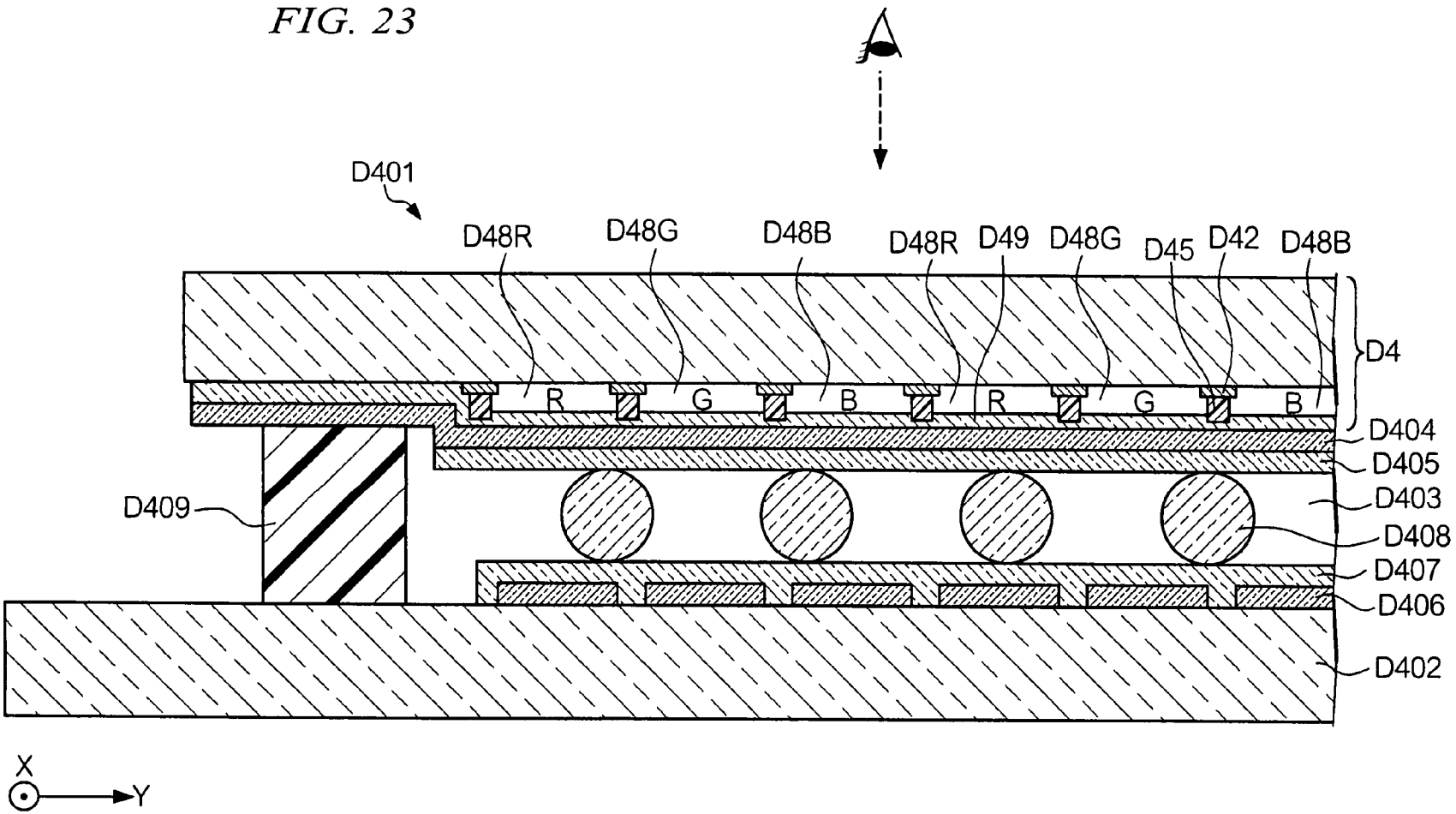
FIG. 23 is a cross-sectional view of a liquid crystal device comprising the color filter.

A description will next be given of a passive matrix type liquid crystal device as an example of an electronic optical device having a color filter D4 manufactured using the above method. FIG. 23 is a cross-sectional view of a liquid crystal device having a color filter D4. It is to be noted that in FIG. 23 the color filter D4 is shown upside down in relation to the color filter D4 in FIG. 22B.

As shown in FIG. 23, a liquid crystal device D401 comprises a color filter D4, a counter substrate D402 facing the color filter D4 across a space, the space being liquid crystal layer D403, and being filled with STN (Super Twisted Nematic) liquid crystal composition. Though not shown, a polarizing plate is mounted to the outside surface (an opposite surface of the liquid crystal layer D403 side) of the counter substrate D402 and the color filter D4, respectively. It is to be noted that the liquid crystal device D401 is viewed from the color filter D4 side.

A plurality of first electrodes D404 made of transparent conductive layers such as ITO (Indium Tin Oxide) is mounted to the liquid crystal layer D403 side surface of the protection layer D49 of color filter D4. These first electrodes D404 are electrode strips extending in the Y direction of the figure, spaced from one another. A first orientation film D405 may be a polyimide film with, for example, a rubbing treatment applied and is formed so as to cover the first electrodes D404 and the color filter D4.

Strip-shaped second electrode D406 are provided, on the liquid crystal layer D403 side surface of the counter substrate D402, the second electrodes D406 extending in the X direction of the figure so as to intersect the above first electrodes D404 respectively. These second electrodes D406 are made of transparent conductive materials such as ITO and are formed spaced from one another. A second orientation film D407 may be a polyimide film with, for example, a rubbing treatment applied and is formed so as to cover the second electrodes D406 and the counter substrate D402.

A spacer D408 interposed between the first orientation film D405 and the second orientation film D407 is a member used for maintaining an approximately constant thickness of the liquid crystal layer D403 (i.e., a cell gap). A sealant D409 prevents the liquid crystal layer D403 from leaking to the outside. The intersected portions between the first electrodes D404 and the second electrodes D406 function as pixels when viewed from the observer's side, and color layers D48R, D48G, and D48B of the color filter D4 are positioned at the portions functioning as the pixels.

Although not shown, a reflection layer may be provided at the back surface of the liquid crystal layer D403, thereby making a reflection-type liquid crystal device. A backlight may be provided at the back surface of the liquid crystal device D401, thereby making a transparency-type liquid crystal device.

Liquid crystal device D401 may be modified so that the liquid crystal layer D403 is positioned in the observer's side of the color filter D4, whereas in the above description, the color filter D4 is positioned on the observer's side of the liquid crystal layer D403. Further, the color filter D4 is not limited for use in a passive matrix type liquid crystal device such as a liquid crystal device D401, but may be applied for use in an active matrix type liquid crystal display device that drives the liquid crystal by means of active elements such as a TFD (Thin Film Diode) element or a TFT (Thin Film Transistor) element.

<Method for Manufacturing an Organic EL Element:>

Figure 24:
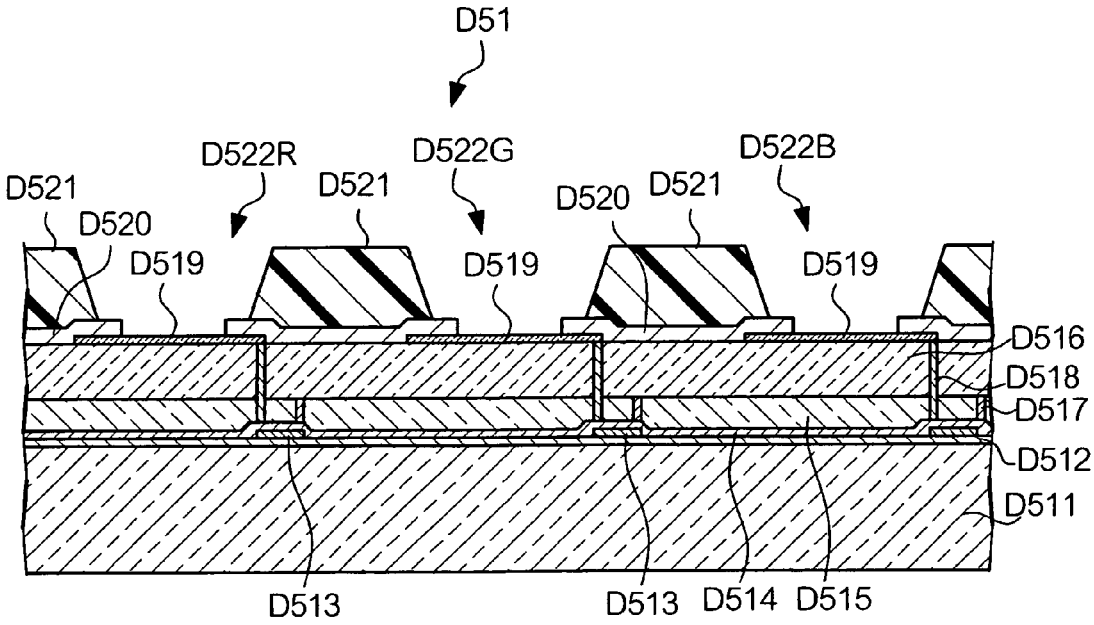
FIG. 24 is a diagram for describing a method for manufacturing an organic EL display device using the droplet ejecting device.

A description will be next given of a method for manufacturing an organic EL display device, using the droplet ejecting device 10. FIG. 24 is a diagram showing an organic EL device during its manufacturing process. The figure shows a cross-sectional view of the basic substance of an organic EL display immediately before a hole injection layer is formed by the droplet ejecting device 10.

As shown in FIG. 24, the basic substance D51 of an organic EL display has a substrate D511 such as glass with light transparent property. The substrate D511 is covered by a primary coating protection film D512 made of silicon oxide film. Semiconductor film D513 is formed over the primary coating protection film D512, for example, by means of a low-temperature polysilicon process. Semiconductor film D513 has a source electrode and a drain electrode formed, for example, by means of a high-concentrated cation implantation.

A gate insulation film D514 is formed so as to cover the primary coating protection film D512 and the semiconductor film D513. A gate electrode (not shown) consisting of Al, Mo, Ta, Ti, W, and the like is laminated over portions, of the gate insulator film D514, covering the semiconductor film D513. Further, a first interlayer insulation film D515 and a second interlayer insulation film D516 are laminated in the listed order so as to cover the gate insulation film D514 and the gate electrode.

Arranged in a matrix on the second interlayer insulation film D516 are pixel electrodes D519 such as ITO with light transparent property. The electrodes D519 correspond to pixel areas in the organic EL device. The pixel electrodes D519 are connected to the source electrode of the semiconductor film D513 through a contact hole D518 penetrating the first interlayer insulation film D515 and the second interlayer insulation film D516.

A power source line (not shown) is provided on the first interlayer insulation film D515. The power source line is connected to the drain electrode of the semiconductor film D513 through a contact hole D517 penetrating the first interlayer insulation film D515.

A lower layer film D520 is made of inorganic materials such as silicon oxide film, and is formed mainly in a space between pixel electrodes D519 to cover the end rims of the pixel electrodes D519. A bank D521 is a type of a partition formed on the lower layer film D520 and is a pattern formed of materials with high heat resistance and solvent resistant properties, such as acrylic resin and polyimide resin.

The top surface of the pixel electrodes D519 is rendered lyophilic by means of a plasma treatment using, for example, oxygen as a treatment gas. The side surface of the banks D521 is rendered water-repellent by a plasma treatment using, for example, methane tetrafluoride as a treatment gas.

Among the above components of organic EL display basic substance D51, areas surrounded by lower layer films D520 and banks D521 (hereinafter referred to as "a light emitting area") are represented as D522R, D522G, or D522B, each having a top surface which is a pixel electrode D519 which is laminated first with a hole injection layer and then with an organic EL layer. An organic EL layer capable of emitting red light is formed in the light emitting area D522R; another organic EL layer capable of emitting green light is formed in the light emitting area D522G; and another organic EL layer capable of emitting blue light is formed in the light emitting area D522B. These organic EL layers are formed, using the above described droplet ejecting device 10.

Figure 25A:
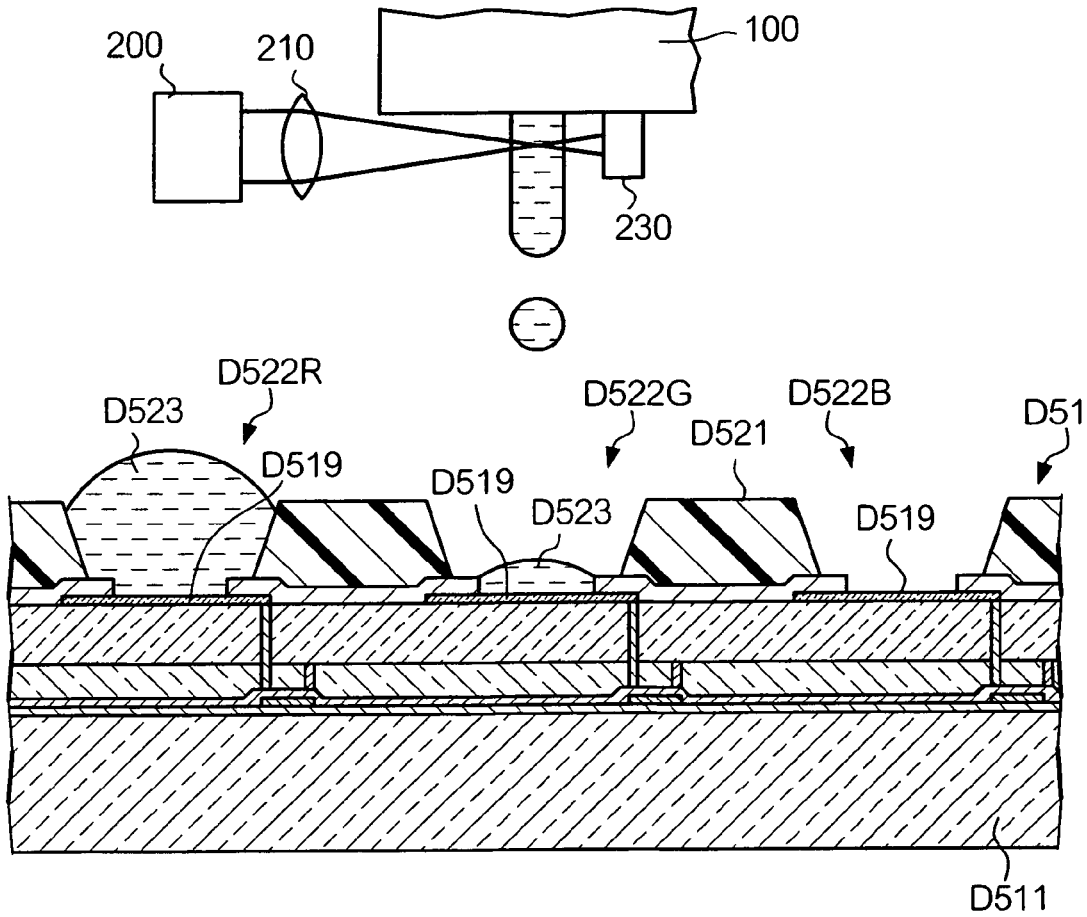
FIGS. 25A and 25B are diagrams for describing a method for manufacturing the organic EL display device using the droplet ejecting device.
Figure 25B:
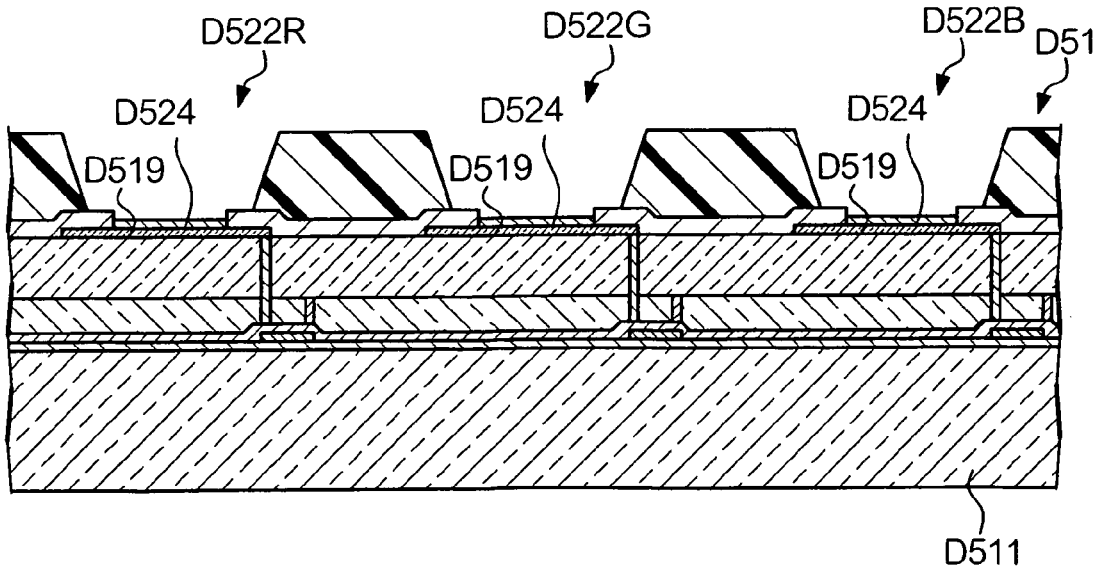

FIGS. 25A and 25B are diagrams showing how a hole injection layer is formed by droplet ejecting device 10. As shown in FIG. 25A, a droplet containing hole injection materials is ejected from ejecting head 100 of droplet ejecting device 10 onto each light emitting area D522R, D522G, and D522B, while the formation of a droplet is assisted by means of a laser beam.

As a result, a droplet D523 containing hole injection materials is applied on a pixel electrode D519 in each light emitting area D522R, D522G, and D522B. Since the top surface of pixel electrodes D519 has been made hydrophilic and the side surface of banks D521 water-repellant, a droplet D523 is enabled to adhere to a pixel electrode D519. Liquid (droplets) applied on each pixel electrode D519 eventually becomes dry, and form hole injection layers D524 as shown in FIG. 25B.

Figure 26A:
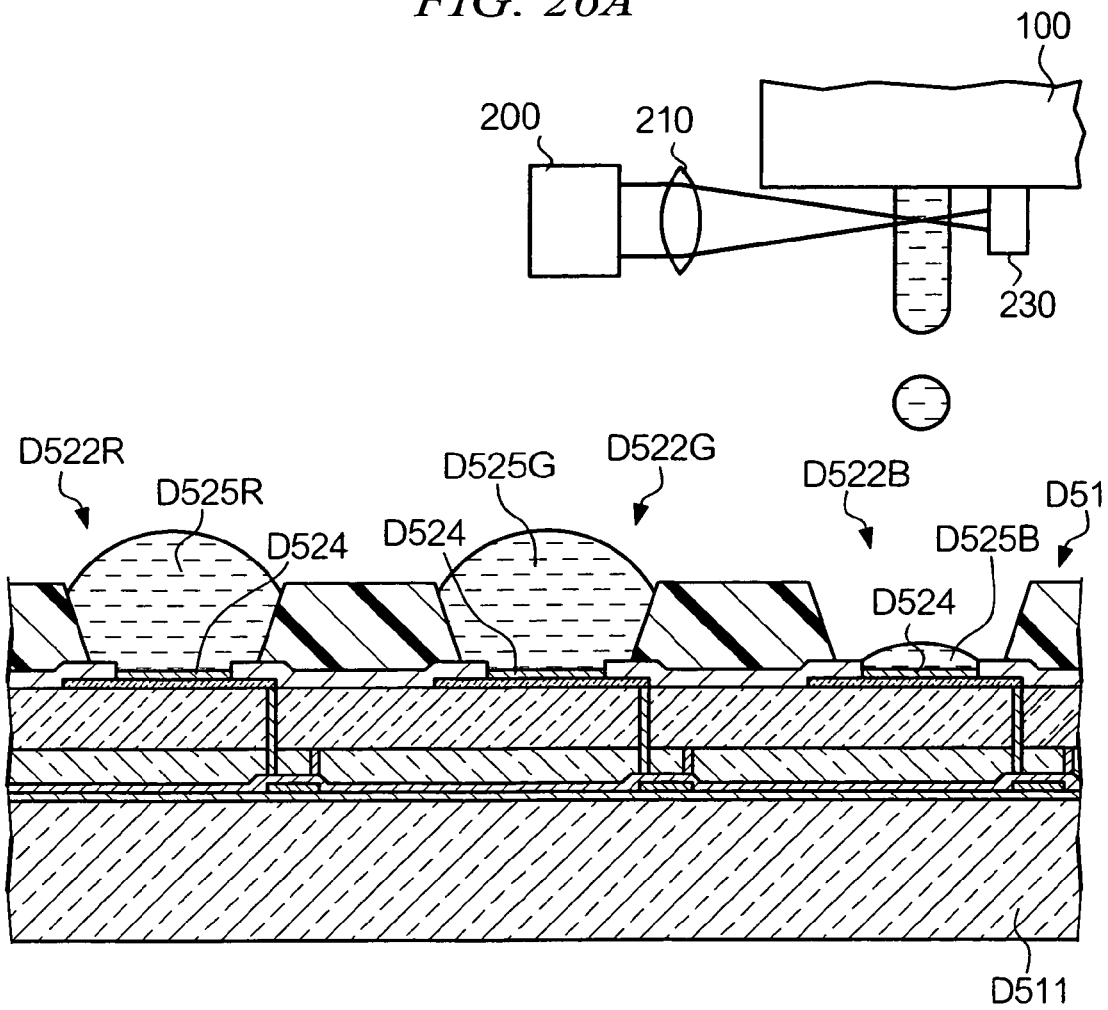
FIGS. 26A and 26B are diagrams for describing a method for manufacturing the organic EL display device using the droplet ejecting device.
Figure 26B:
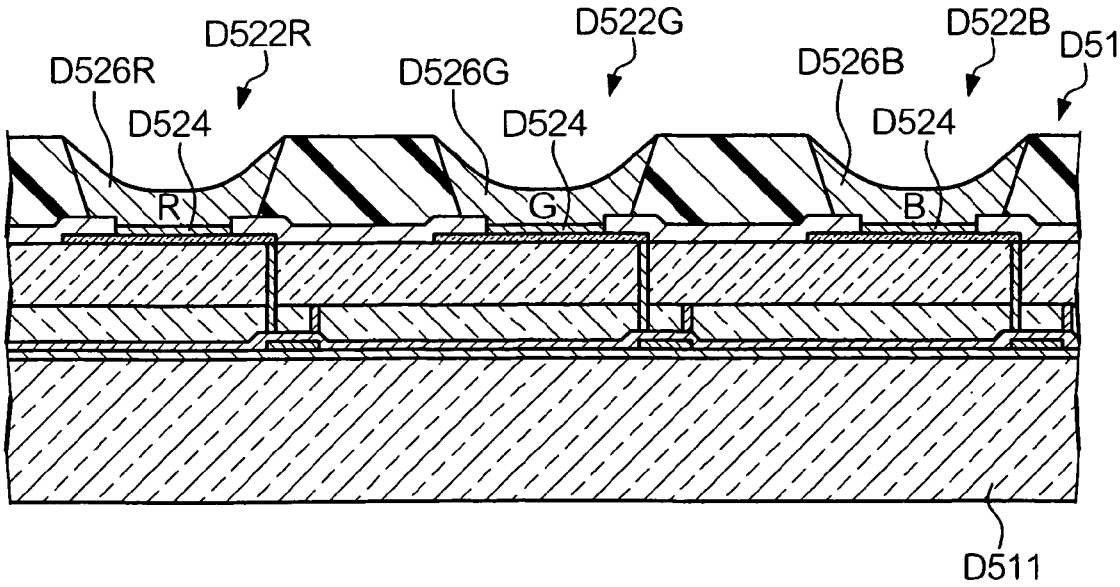

Next, a description will be given of a method of generating an organic EL layer on hole injection layer D524. FIGS. 26A and 26B are diagrams showing that an organic EL layer is formed using droplet ejecting device 10. As shown in FIG. 26A, a droplet containing an organic EL material that differs for each light-emitting area D522R, D522G, and D522B is ejected from ejecting head 100, the formation of which droplet is assisted by a laser beam. Specifically, a droplet (liquid D525R) containing an organic EL material capable of emitting red light is ejected onto light emitting area D522R; a droplet (liquid D525G) containing an organic EL material capable of emitting green light is ejected onto light emitting area D522G; and a droplet (liquid D525B) containing an organic EL material capable of emitting blue light is ejected onto light emitting area D522B. FIG. 26A shows that a droplet (liquid D525B) is being ejected for the light emitting area D522B and also that liquids D525R and D525G have already been applied on light emitting areas D522R and D522G, respectively.

When liquids D525R, D525G, and D525B applied on each hole injection layer D524 become dry, organic EL layers D526R, D526G, and D526B are formed on hole injection layers D524, as shown in FIG. 26B. The organic EL layer D526R formed on light emitting area D522R is capable of emitting red light; the organic EL layer D526G formed on light emitting area D522G is capable of emitting green light; and the organic EL layer D526B formed on light emitting area D522B is capable of emitting blue light.

Figure 27:
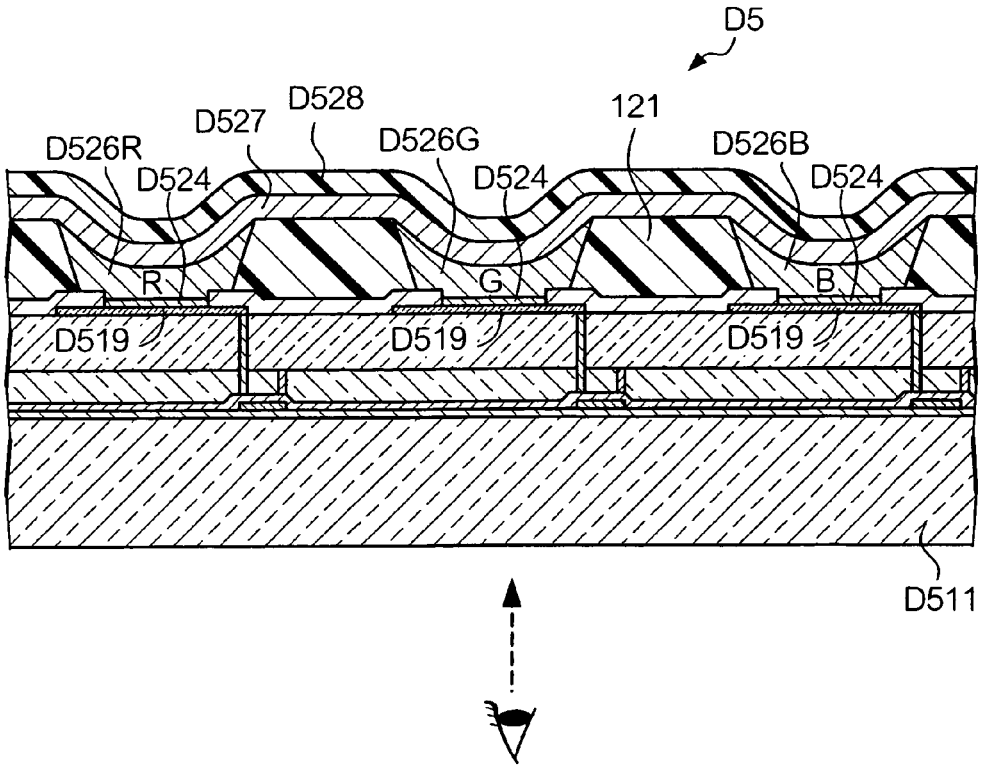
FIG. 27 is a diagram for describing a method for manufacturing the organic EL display device using the droplet ejecting device.

A cathode D527 is then formed, as shown in FIG. 27, to cover banks 121, organic EL layers D526R, D526G, and D526B. Cathode D527 is a conductive substance such as aluminum, and is formed as a thin film by means of a vapor deposition method. A sealing compound D528 is then formed over cathode D527. An organic EL device D5 is completed through the above processes.

In organic EL device D5, voltage is applied by semiconductor film D513 selectively onto organic EL layers D526R, D526G, or D526B and hole injection layer D524. Organic EL layers D526R, D526G, and D526B emit a light having a corresponding color when voltage is applied. The light emitted from each organic EL layer D526R, D526G, or D526B passes through substrate D511 and is visually identified by an observer located in the substrate D511 side of organic EL device D5.

<Method for Manufacturing a Plasma Display Device:>

Figure 28:
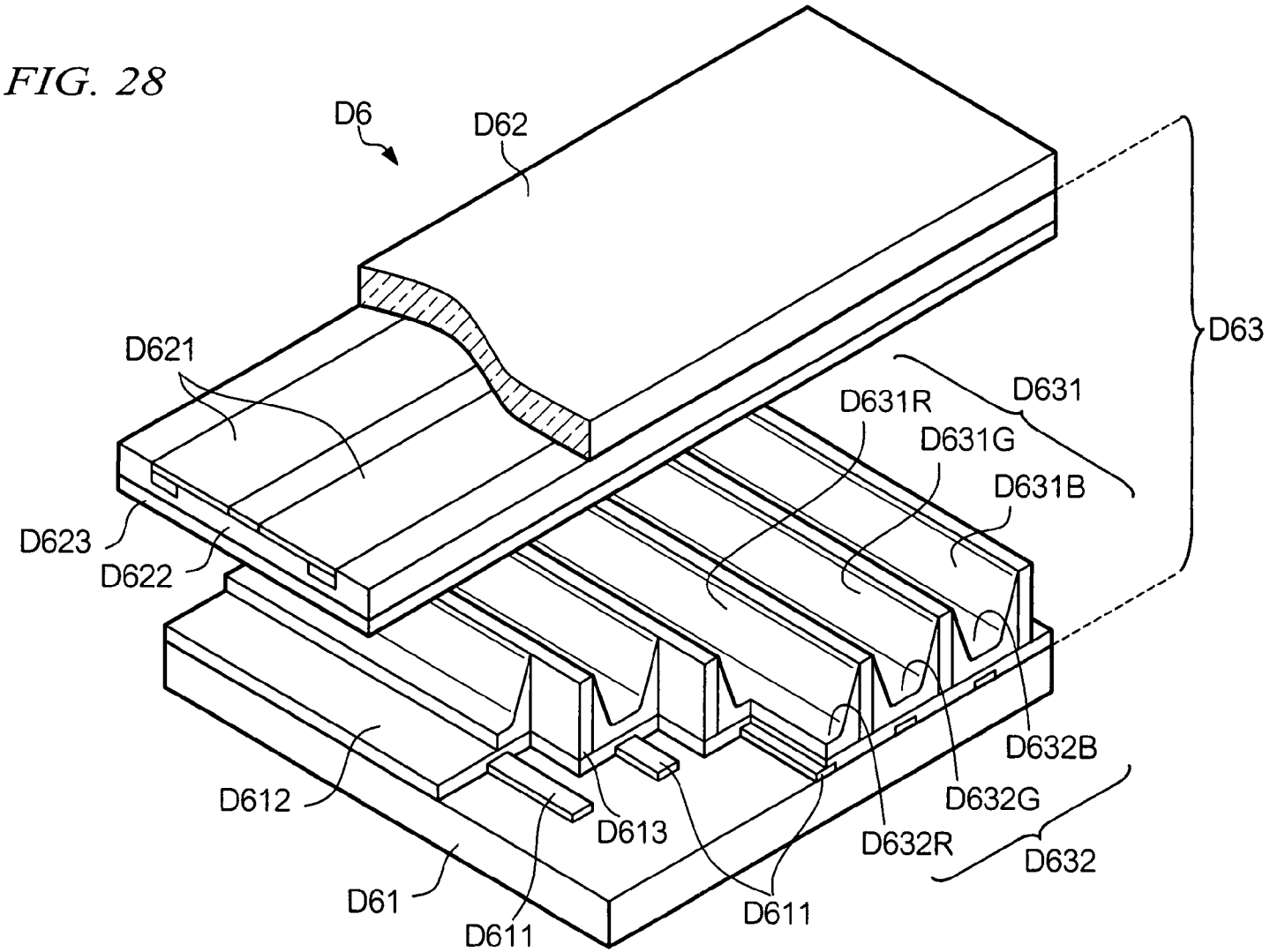
FIG. 28 is a diagram for describing a method for manufacturing a plasma display device using the droplet ejecting device.

A description will be first given of an overview of a configuration of a plasma display device. FIG. 28 is an exploded perspective view of a plasma display device. As shown in the figure, a plasma display device D6 comprises a first substrate D61, a second substrate D62 facing first substrate D61, and a discharge display unit D63 interposed between first and second substrates D61 and D62. Discharge display unit D63 has a plurality of discharge chambers D631. The discharge chambers D631 are arranged so as to form a pixel with a trio of a red color discharge chamber D631R, a green color discharge chamber D631G, and a blue color discharge chamber D631B.

The second substrate D62 side of first substrate D61 is provided with a plurality of strip-shaped address electrodes D611 formed in stripes. A dielectric layer D612 is formed to cover the address electrodes D611 and first substrate D61. A partition D613 extends transversely to the dielectric layer D612 approximately at the center line of the space between address electrodes D611. Partitions D613 include one (shown) extending on both sides of an address electrode D611 widthwise and one (not shown) extending in the direction intersecting an address electrode D611 approximately at right angles. An area partitioned by the partitions D613 comprises a discharge chamber D631.

A fluorescent substance D632 is mounted within discharge chamber D631. Fluorescent substance D632 includes a red fluorescent substance D632R mounted on the first substrate D61 side of a red discharge chamber D631R, a green fluorescent substance D632G mounted on the first substrate D61 side of a green discharge chamber D631G, and a blue fluorescent substance D632B mounted on the first substrate D61 side of a blue discharge chamber D631B.

Further, on the first substrate D61 side of the second substrate D62, a plurality of strip-shaped display electrode D621 is formed in stripes in the direction intersecting the address electrodes D611 approximately at right angles. A dielectric layer D612 and a protection layer D623 containing MgO are laminated to cover second substrate D62 and display electrodes D621 in the listed order from the second substrate D62 side.

The first substrate D61 and second substrate D62 are put together so that the address electrodes D611 and display electrodes D621 face and intersect each other approximately at right angles. It is to be noted that the above address electrodes D611 and display electrodes D621 are connected to an alternating-current power supply (not shown).

Given the above configuration, each address electrode D611 and display electrode D621 are energized, thereby causing a fluorescence substance D632 in a discharge display unit D63 to be excited and emit light, and as a result, a color display is enabled.

Next, a description will be given of a method for manufacturing a plasma display device D6 using droplet ejecting device 10 according to the embodiment. The droplet ejecting device 10 may be used for forming an address electrode D611, a display electrode D621, and a fluorescence substance D632 included in plasma display device D6.

To form an address electrode D611, a droplet containing a conductive substance is ejected from droplet ejecting device 10 onto an address electrode forming area, to apply a droplet on the area, in the same way as address electrode D611. The droplet is ejected, as in the above embodiment, from ejecting head 100, while its formation being assisted by a laser beam. Conductive materials contained in a droplet may be metal particles, conductive polymer, or the like. When the applied droplet becomes dry, an address electrode D611 is formed.

To form a display electrode D621, a droplet containing conductive materials is ejected from droplet ejecting device 10 to apply the droplet onto a display electrode forming area in the same way as in the case of an address electrode D611. A display electrode D621 is formed when the applied droplet becomes dry.

In forming a fluorescence substance D632, three types of liquid materials each containing one of red, green, or blue fluorescence materials are selectively ejected from ejecting head 100 as a droplet so that the ejected droplet reaches a discharge chamber D631 of the same color. When the applied droplet becomes dry, a fluorescence substance D632 is formed.

Droplet ejecting device 10 may be applied to the manufacturing of an electronic optical device such as a SED (Surface-Conduction Electron-Emitter Display) that utilizes a surface-conductive electron emission element, in addition to the above-described electronic optical devices.

The droplet ejecting device 10 may also be applied to the patterning of photoresist, and the device 10 may also be used in applying a droplet containing organism substance such as DNA (deoxyribonucleic acid) and protein onto a predetermined location. Whatever the type of functional material contained in an applied droplet, the formation of a droplet ejected from ejecting head 100 is assisted, and therefore, a microscopic droplet can be ejected regardless of the viscosity of a liquid. Thus, the accuracy of the patterning can be enhanced.

It is to be noted that an "electronic optical device" as used in the description is not limited to a device utilizing changes of optical characteristics (i.e. electronic optical effects) such as changes of birefringence, changes of rotatory polarization, and changes of light dispersion, but also includes a device in general that emits, transmits, or reflects a light according to applied signal voltages.

Japanese patent application No. 2002-337121 filed Nov. 20, 2002 and Japanese patent application No. 2003-299317 filed Aug. 22, 2003 are herby incorporated by reference.

What is claimed is:

1. A droplet ejecting method, comprising:

ejecting a liquid stored in a pressure chamber from an ejecting nozzle by applying pressure to the pressure chamber;

detecting a liquid column being ejected from the ejecting nozzle; and giving, to the liquid column, an energy that separates the liquid column from the liquid stored in the pressure chamber, the energy being given at a timing when a predetermined time period has elapsed since the ejection of the liquid column.

2. A droplet ejecting method according to claim 1, wherein the energy is optical energy.

3. A droplet ejecting method according to claim 2, wherein the optical energy is coherent-light energy.

4. A droplet ejecting method according to claim 2, wherein the optical energy comprises plural light beams traveling in different directions.

5. A droplet ejecting method according to claim 2, wherein the optical energy comprises at least two light beams traveling in opposite directions.

6. A droplet ejecting method according to claim 1, wherein the energy is thermal energy.

7. A droplet ejecting method according to claim 1, wherein a longer period is set as the predetermined time period where a volume of liquid to be ejected is larger.

8. A droplet ejecting method according to claim 1, further comprising:

emitting light from a light emitter onto the liquid column; and receiving, by a photo receiver, the light emitted from the light emitter through the liquid, the receiver facing the light emitter through the liquid column, wherein the ejection of the liquid column is detected in response to a change in an intensity of light received by the photo-receiver.

9. A droplet ejecting method according to claim 8, further comprising:

increasing the energy of the light emitted by the light emitter at a timing when a predetermined time period has elapsed since the ejection of the liquid column, wherein the energy to be given to the liquid column is provided by the light emitted by the light emitter.

10. A droplet ejecting device comprising:

an ejector that is adapted to eject a liquid stored in a pressure chamber from an ejecting nozzle by applying pressure to the pressure chamber;

an ejection timing detector that is adapted to detect a liquid column being ejected from the ejecting nozzle;

a droplet separator that is adapted to give, to the liquid column, an energy that separates the liquid column from the liquid stored in the pressure chamber; and a controller that is adapted to control the droplet separator to give an energy at a timing when a predetermined time period has elapsed since the ejection of the liquid column detected by the ejection timing detector.

* * * * *